US012123277B2

(12) United States Patent
Main et al.

(10) Patent No.: US 12,123,277 B2
(45) Date of Patent: Oct. 22, 2024

(54) SEALING ASSEMBLY FOR WELLBORE OPERATIONS

(71) Applicant: Halliburton Energy Services, Inc., Houston, TX (US)

(72) Inventors: Barry Richardson Main, Alford (GB); Scott Elliott Wallace, Bridge of Don (GB); Peter D W Inglis, Dundee (GB); Shane Robert Burckhard, Decatur, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/546,984

(22) Filed: Dec. 9, 2021

(65) Prior Publication Data

US 2022/0389786 A1 Dec. 8, 2022

Related U.S. Application Data

(60) Provisional application No. 63/202,237, filed on Jun. 2, 2021.

(51) Int. Cl.

| | |
|---|---|
| ***E21B 33/12*** | (2006.01) |
| ***E21B 33/128*** | (2006.01) |
| ***E21B 34/10*** | (2006.01) |

(52) U.S. Cl.

CPC ..... *E21B 33/1208* (2013.01); *E21B 33/1285* (2013.01); *E21B 34/10* (2013.01); *E21B 2200/01* (2020.05)

(58) Field of Classification Search

CPC .. E21B 33/1208; E21B 33/1285; E21B 34/06; E21B 34/10

See application file for complete search history.

(56) References Cited

U.S. PATENT DOCUMENTS

| | | | | |
|---|---|---|---|---|
| 5,433,269 | A * | 7/1995 | Hendrickson | E21B 33/128 166/134 |
| 6,298,916 | B1 * | 10/2001 | Tibbles | E21B 34/14 166/149 |
| 7,322,422 | B2 * | 1/2008 | Patel | E21B 33/127 166/278 |
| 7,735,568 | B2 * | 6/2010 | Xu | E21B 33/126 166/387 |
| 7,748,459 | B2 * | 7/2010 | Johnson | E21B 34/08 166/305.1 |
| 10,167,696 | B2 * | 1/2019 | Foubister | E21B 43/08 |

(Continued)

OTHER PUBLICATIONS

"PCT Application No. PCT/US2021/072862, International Search Report and Written Opinion", Apr. 11, 2022, 13 pages.

(Continued)

*Primary Examiner* — Theodore N Yao

(74) *Attorney, Agent, or Firm* — DeLizio, Peacock, Lewin & Guerra, LLP

(57) ABSTRACT

A sealing assembly comprising a plurality of components including an upper sealing element and a lower sealing element, the sealing assembly configured to encircle a tubular string positioned within a casing of a wellbore. The sealing assembly is configured to be actuatable to extend sealing elements between the tubular string and an inner surface of the casing to form a fluid seal between the tubular element and the inner surface of the casing.

17 Claims, 8 Drawing Sheets

(56) References Cited

U.S. PATENT DOCUMENTS

| | | | | |
|---|---|---|---|---|
| 2004/0129433 | A1* | 7/2004 | Krawiec | E21B 33/12 166/120 |
| 2005/0161232 | A1 | 7/2005 | Patel et al. | |
| 2015/0226047 | A1* | 8/2015 | Robb | E21B 33/1285 166/185 |
| 2015/0308250 | A1* | 10/2015 | Anders | E21B 43/164 166/308.1 |
| 2017/0002621 | A1* | 1/2017 | White | E21B 33/128 |
| 2017/0122066 | A1 | 5/2017 | Stæhr | |
| 2018/0328132 | A1* | 11/2018 | Walton | E21B 33/1293 |
| 2019/0195058 | A1 | 6/2019 | Robb et al. | |
| 2020/0182026 | A1 | 6/2020 | Molstre | |
| 2021/0071513 | A1 | 3/2021 | Qu | |
| 2021/0108482 | A1* | 4/2021 | Yoshii | E21B 33/1208 |

OTHER PUBLICATIONS

"PCT Application No. PCT/US2021/072862, International Preliminary Report on Patentability", Dec. 14, 2023, 9 pages.

* cited by examiner

SEALING ASSEMBLY FOR WELLBORE OPERATIONS

RELATED APPLICATION

This application claims the benefit of priority to U.S. Provisional Patent Application Ser. No. 63/202,237, filed Jun. 2, 2021, which is incorporated by reference herein in its entirety.

TECHNICAL FIELD

The disclosure generally relates to an apparatus used in wellbore operations, and more particularly, a sealing assembly for wellbore operations.

BACKGROUND

Various wellbore operations can incorporate sealing assemblies to separate the wellbore into different sections during such operations. For example, annular safety valves can be used in various completion and/or workover assemblies such as those used in gas lift operations in subterranean wells. In a gas lift operation, gas, such as hydrocarbon gas, can be flowed from the earth's surface to gas valves positioned near a producing formation intersected by a well. The gas valves are typically installed in production tubing extending to the earth's surface and permit the gas to flow from an annulus, between the production casing and production tubing, to the interior of the tubing. Once inside the tubing, the gas rises, due to its buoyancy, and carries fluid from the formation to the earth's surface along with it.

BRIEF DESCRIPTION OF THE DRAWINGS

Embodiments of the disclosure may be better understood by referencing the accompanying drawings.

Figure 1:
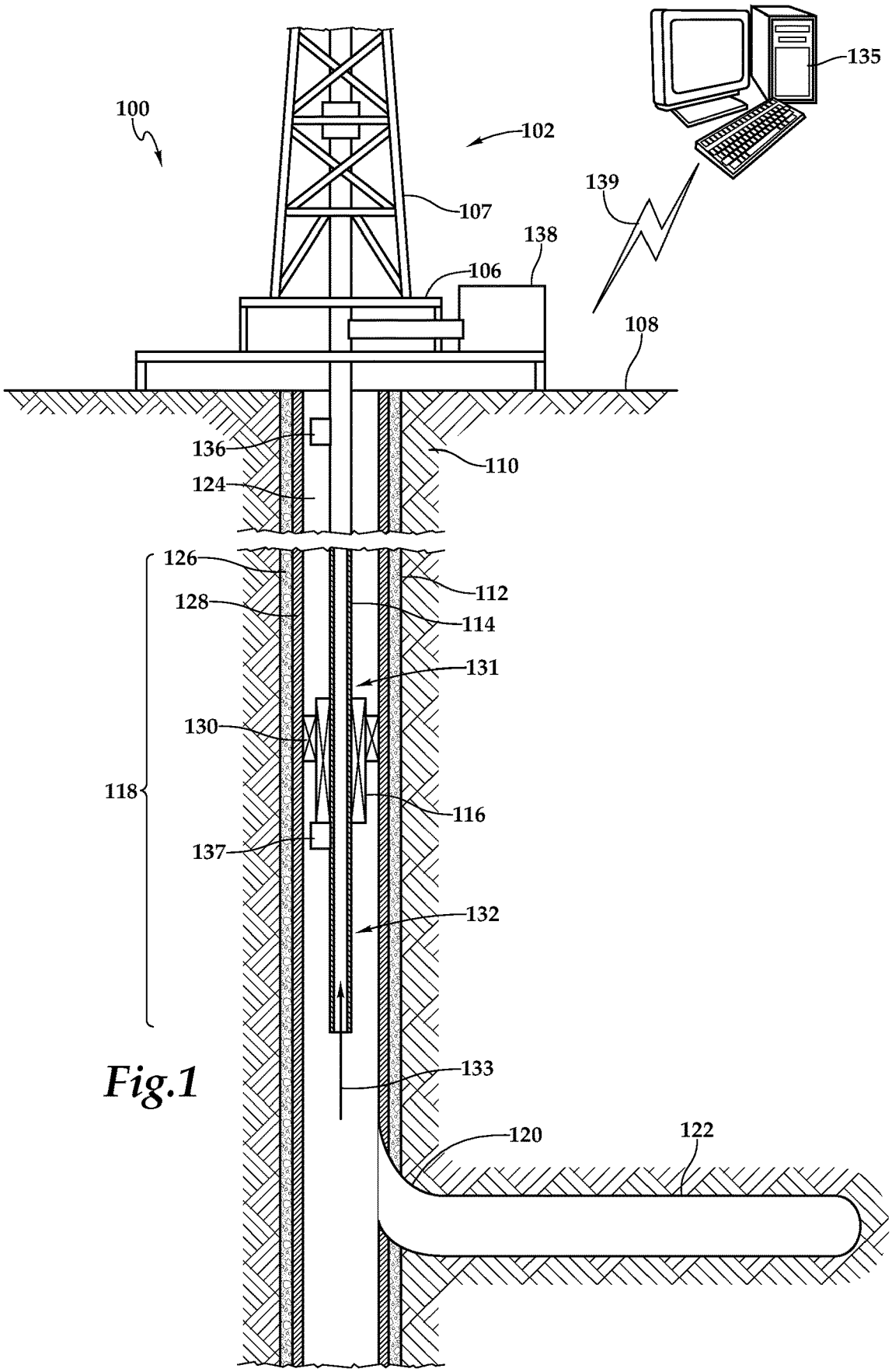
FIG. 1 depicts an example wellbore operating environment configured to recover hydrocarbons and/or other resources, according to various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown exaggerated in scale or in somewhat schematic form, and some details of conventional elements may not be shown in the interest of clarity and conciseness.

DETAILED DESCRIPTION

The description that follows includes example systems, apparatus, methods, and techniques that embody aspects of the disclosure. However, it is understood that this disclosure may be practiced without these specific details. For instance, this disclosure refers to embodiments of a sealing assembly that may be used in conjunction with an annular safety valve in illustrative examples. Aspects of this disclosure can be also applied to other types of valves and for other types of wellbore sealing operations. For example, the sealing assemblies as described herein may be used for bridge plugs, packers, straddle packers, etc., for single direction sealing to remove friction by parts of the sealing assembly (as described herein).

In various embodiments of wellbore operations, a gas or other fluid is pumped from the surface into a wellbore as part of a gas lift operation., Because the gas is pumped from the earth's surface to one or more gas valves through the annulus of the wellbore, it is highly desirable, from a safety standpoint, to install a valve in the annulus. The valve is commonly known as an annular safety valve. Its function is to control the flow of fluids axially through the annulus and minimize the volume of gas contained in the annulus between the valve and surface. In most cases, the annular safety valve is designed to hold pressure from below only, and to close when a failure or emergency has been detected.

Example embodiments include an asymmetric annular sealing assembly ("sealing assembly") that is used with an annular safety valve as part of various wellbore operations. While setting a conventional symmetric sealing assembly against the casing, the direction for which the compressive load is applied to this assembly may be hindered by a symmetrical seal component configuration. This problem is sometimes referred to as the hand brake effect.

This effect can reduce the available setting force that can be transmitted into the sealing assembly, which in turn reduces the available sealing characteristics of said assembly. Unlike most packers and plugs, the annular safety valve is used to isolate pressure primarily from the annulus below the valve while only needing to isolate a minimum pressure from above. When a differential pressure is applied from above the annulus safety valve, the valve can open up a separate valve system to allow the above annulus pressure to be injected into the annulus below.

Thus, this single direction sealing requirement negates the need for a symmetrical sealing configuration. Accordingly, and according to some embodiments, this requirement allows for the components that contribute the hand brake effect to be removed from the sealing assembly. Therefore, example embodiments as described herein include an annular sealing assembly that is "asymmetrical," to remove the hand brake effect. In applications where pressure is required to be sealed primarily from one direction, the setting force that can be transmitted into the sealing assembly can be increased due to the reduction of the hand brake effect.

Accordingly, example embodiments can include a single direction sealing element that enables existing product limitations to be extended by increasing the available setting force into the sealing assembly. Additionally, using an asymmetrical sealing assembly as described herein allows sealing to occur in situations where setting pressure must be reduced due to well conditions or rig set ups.

As further described below, example embodiments of sealing assemblies can reduce the hand brake effect that can cause friction with adjacent surfaces by one or more of the following: 1) removing one or more elements of the sealing assembly, 2) moving one or more of such elements, 3), altering one or more of such elements, and 4) altering one or more compositions of such elements. Removing or reducing this friction can reduce setting force or improve the transfer of the setting force to the seal. This removal or reduction can increase percentage of setting force transferred to the seal.

FIG. 1 depicts an example wellbore operating environment 100 configured to recover hydrocarbons and/or other resources, according to various embodiments. As depicted in FIG. 1, the wellbore operating environment 100 comprises a drilling rig 102 that is positioned on the earth's surface 108 and extends over a wellbore 112 that penetrates a subterranean formation 110. The wellbore 112 may be drilled into the subterranean formation 110 using any suitable drilling technique. The wellbore 112 extends substantially vertically away from the earth's surface 108 over a vertical wellbore portion 118, deviates from vertical relative to the earth's surface 108 over a deviated wellbore portion 120, and transitions to a horizontal wellbore portion 122. In alternative operating environments, all or various portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and/or other types of wellbores for drilling and completing one or more production zones. Further, the wellbore may be used for both producing wells and injection wells. In various embodiments, the wellbore may be used for purposes other than or in addition to hydrocarbon production, such as uses related to geothermal energy and/or the production of water (e.g., potable water). Although depicted as a land-based or on-shore wellbore, embodiments of the sealing assemblies as described herein are equally well suited for use in offshore operations. Moreover, embodiments of the sealing assembly as presented in this disclosure are not limited to use only in the environment as depicted in FIG. 1, and can also be used, for example, in other well operations such as non-conductive production tubing operations, jointed tubing operations, coiled tubing operations, combinations thereof, and the like.

A wellbore tubular string 114 comprising an annular safety valve 116 with a sealing assembly 130 as described herein may be included as part of the wellbore operating environment 100, including tubular string 114 having been lowered into the wellbore 112 for a variety of drilling, completion, workover, and/or treatment procedures that may be performed throughout the life of the wellbore. The embodiment shown in FIG. 1 illustrates the wellbore tubular string 114 in the form of a completion string being lowered into casing 128 and held in place within the wellbore 112 via cement 126, thereby forming an annulus 124 between wellbore tubular string 114 and casing 128. It should be understood that the wellbore tubular string 114 is equally applicable to any type of wellbore tubular being inserted into a wellbore, including as non-limiting examples drill pipe, production tubing, rod strings, and coiled tubing. In the embodiment shown in FIG. 1, the wellbore tubular string 114 comprising the annular safety valve 116 may be conveyed into the wellbore in a conventional manner.

In various embodiments, drilling rig 102 comprises a derrick 107 with a rig floor 106 through which the wellbore tubular string 114 extends downward from the drilling rig 102 into the wellbore 112. The drilling rig 102 comprises a motor driven winch and other associated equipment (not shown in FIG. 1) for extending the wellbore tubular string 114 into the wellbore 112 to position the wellbore tubular string 114 at a selected depth. While the operating environment depicted in FIG. 1 refers to a stationary drilling rig 102 for lowering and setting the wellbore tubular string 114 comprising the annular safety valve 116 within a land-based wellbore 112, in alternative embodiments, mobile workover rigs, wellbore servicing units (such as coiled tubing units), and the like may be used to lower the wellbore tubular string 114 into a wellbore. It should be understood that a wellbore tubular string 114 may alternatively be used in other operational environments, such as within an offshore wellbore operational environment. In alternative operating environments, a vertical, deviated, or horizontal wellbore portion may be cased and cemented and/or portions of the wellbore may be uncased.

As shown in FIG. 1, wellbore operating environment 100 includes an annular safety valve 116 located adjacent to a portion of the wellbore tubular string 114, and extending along a length of the wellbore tubular string. Although shown in cross-section in FIG. 1, annular safety valve 116 comprises a housing that is generally configured as a hollow cylindrical shape, wherein the wellbore tubular string 114 extends through the hollow portion of the cylindrically shaped annular safety valve 116, and wherein the annular safety valve encircles an outer surface or perimeter of the tubular string for 360 degrees radially around and along a length longitudinally of the wellbore tubular string 114. In various embodiments, the annular safety valve 116 is in direct physical contact with the outer surface of the wellbore tubular string 114 over a length longitudinally of the wellbore tubular string where the annular safety valve is located, and may be affixed to the outer surface of the wellbore tubular string, for example by welding, in a manner so that the annular safety valve's longitudinal position along the wellbore tubular string is fixed and not movable in the longitudinal direction.

In addition to the annular safety valve 116, embodiments of wellbore operating environment 100 include a sealing assembly 130. Sealing assembly 130 is located adjacent to and encircles an outer surface of the annular safety valve 116, and extends along a length longitudinally of the outer surface of the annular safety valve 116. Although shown in cross-section in FIG. 1, sealing assembly 130 comprises stack of sealing components configured as a generally hollow cylindrical shape, wherein the wellbore tubular string 114 and the annular safety valve 116 extend through the hollow portion of the cylindrical shaped sealing components, and wherein the sealing assembly 130 encircles an outer surface or perimeter of the annular safety valve for 360 degrees radially around and along a length longitudinally of the annular safety valve. In various embodiments, inner surfaces of the sealing components of sealing assembly 130 are in physical contact with the outer surface of the annular safety valve 116 over a length longitudinally of the annular safety valve, and wherein one or more components forming the sealing components of the sealing assembly 130 may be affixed to the outer surface of the annular safety valve, for example by welding, in a manner so that the longitudinal position of one or more components of the sealing assembly 130 are fixed relative to the position of the annular safety valve.

As further described below, the sealing assembly 130 is configurable in a first configuration wherein the sealing elements included in the sealing assembly are provided in an non-actuated configuration, wherein an outside dimension, such as an outer diameter of the sealing assembly, is smaller than the interior dimension of the casing 128, thus allowing the wellbore tubular string 114, including the annular safety valve 116 and the sealing assembly 130, to be advanced into the wellbore 112 and through the casing 128 without the sealing assembly 130 contacting and/or otherwise causing resistance to the movement of the tubular string 114 through the casing. Once the annular safety valve 116 and the sealing assembly 130 are located at a desired position within the wellbore, sealing assembly 130 may be actuated to a second configuration, wherein when in the second configuration sealing elements included in sealing assembly 130 are compressed and expanded in such a way as to form a fluid seal between the annular safety valve and the interior surface of casing 128. When actuated as described above in this second configuration, the sealing assembly 130 provides a fluid seal between the upper annulus 131, located uphole from the sealing assembly 130 and outside of wellbore tubular string 114, and the lower annulus 132 comprising spaces within the wellbore that are downhole from the sealing assembly and which extend to any downhole wellbores and/or other fluid passageways that are in fluid communication with the lower annulus 132.

In various embodiments, once the sealing assembly 130 has been actuated in place to provide a fluid seal between the area included in upper annulus 131 and the areas in fluid communication with the lower annulus 132, the operation of the wellbore may be performed as follows. Fluid pressure/fluid flow may be provided, for example from the surface 108, and to the areas in fluid communication with upper annulus 131. The fluid pressures and/or fluid flows may be controllably provided by way of fluid communication pathways through annular safety valve 116, which extend around and bypass the sealing assembly 130, from the upper annulus 131 to the lower annulus 132. Any fluid pressure and/or fluid flows that reach the areas within the wellbore that are in fluid communication with lower annulus 132 are prevented from passing back up through lower annulus 132 to the upper annulus 131 by the presence of the sealing assembly 130 providing a fluid seal between these two annuluses.

In various embodiments, as a result of the fluid pressure and/or fluid flows provided to areas in fluid communication with lower annulus 132, a flow of fluid, such as formation fluid or other desirable resources located within the wellbore, may be urged to flow in an uphole direction, as illustratively shown by arrow 133, after entering the open downhole facing end of tubular string 114, wherein the fluid or other resource may proceed through the wellbore tubular string 114 to an area above surface 108, where they can be captured. In various embodiments, the operations being performed on the wellbore after actuation of the sealing assembly 130 may require that pressure differentials be generated and maintained between the upper annulus 131 and other portions of the wellbore that are in fluid communication with lower annulus 132. Despite the pressure differentials, sealing assembly 130 must be capable of being deployed downhole in a manner that assures that the fluid seal formed by the sealing assembly is capable of maintaining the pressure seal despite any pressure differential(s) that might be experienced across the sealing assembly 130.

Embodiments of wellbore operating environment 100 include a computing device 135. Computing device 135 may include one or more processors coupled to computer memory, and other computer related devices such as a display device, and one or more input/output (I/O) devices such as a computer keyboard, a computer mouse, or other devices that allow a user, such as a field technician, to interact with computing device 135. Computing device 135 may be configured to receive input signals, for example signals related to information provided as an output from one or more sensor 136, 137, which in various embodiments provide signals related to sensed levels of pressure that are present within various portions of the wellbore 112. In addition, computing device 135 may be configured to control one or more devices that are configured to provide and/or to control the application of fluid pressure and/or fluid flows to the wellbore 112 (e.g., pumps 138), as part of the operations being performed on the wellbore, In various embodiments computing device 135 is configured to provide output control signals to one or more devices included in the annular control valve 116 in order to control the operation of the annular control valve. Communications between computing device and other devices included in the wellbore operating system 100 are illustratively represented by lightning bolt 139.

It has been found that conventional sealing assemblies, which may comprise three separate sealing elements, are prone to "hand braking" when deployed, which occurs when the different sealing elements of the sealing assembly make contact with the interior surface of the casing at different times during the actual deployment and actuation of the sealing assembly. This "hand braking" effect in some embodiments limits the effective sealing force that may result from the actuation of these conventional sealing assemblies in the downhole environment, and therefore may limit for example the levels of pressure differentials across the seal that the actuated sealing assembles are able to seal against.

Embodiments of the sealing assemblies as described herein reduce or eliminate the effect of "hand braking," and thus are able to provide a higher sealing force compared to various conventional sealing assemblies. The increased level of sealing force that may be achieved by the sealing assemblies as described herein allow for wellbore operations at higher pressure differentials than would be possible with conventional wellbore sealing assemblies configured to work with annular safety valves. Embodiments of the sealing assemblies that may be utilized in wellbore operating environments, such as but not limited to wellbore operating environment 100, are illustrated and further described below with respect to FIGS. 2, 3, 4A-4B, and 5A-5E.

Figure 2:
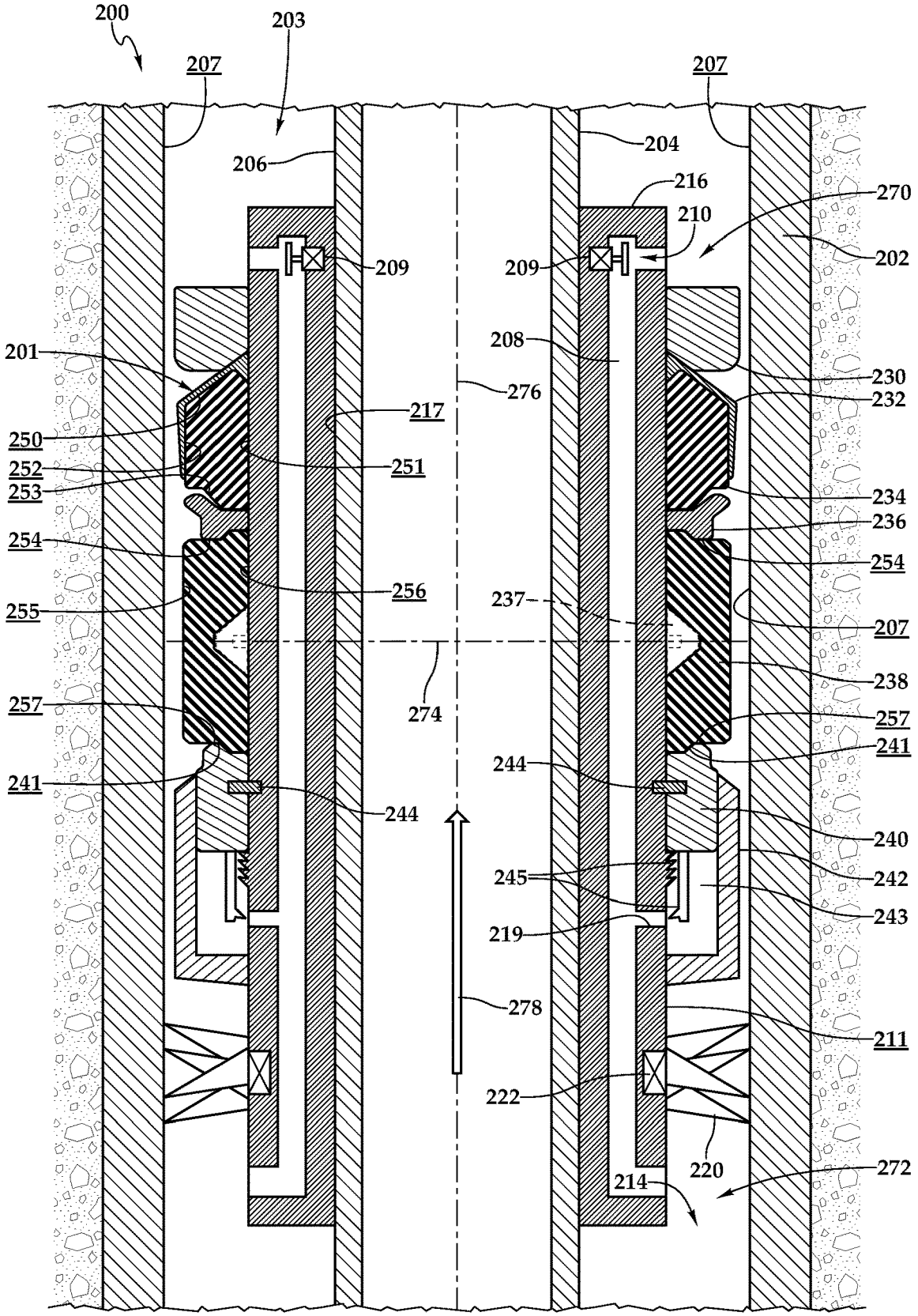
FIG. 2 illustrates cutaway view of a portion of a wellbore including a sealing assembly positioned within a wellbore, according to various embodiments.

FIG. 2 illustrates cutaway view of a portion of a wellbore 200 including a sealing assembly 201 positioned within a wellbore, according to various embodiments. Wellbore 200 includes a casing 202 extending along a longitudinal axis 276 of the wellbore. In various embodiments, casing 202 may be cemented in place within the wellbore, and encircles and partially encloses a generally cylindrical shaped interior cavity 203 formed within the casing. Casing 202 includes an inner surface 207 that is exposed to and encircles the interior cavity 203.

A tubular pipe or fluid conduit (tubular 204), extends through the interior cavity 203 of the casing 202 and along longitudinal axis 276. Tubular 204 may comprise a generally hollow cylindrical shape having a circular shape in cross-section perpendicular to longitudinal axis 276. Tubular 204 may extend in an uphole direction along longitudinal axis 276 for some distance, wherein an opening at the upper end of the tubular (not shown in FIG. 2) may be sealingly coupled to one or more additional sections of piping or other fluid conduits so that tubular 204 forms part of a fluid pathway leading to a surface where wellbore 200 exits the formation material or otherwise is accessible. Tubular 204 may also extend in a downhole direction along longitudinal axis 276 for some distance, wherein an opening in the downhole end of the tubular may be exposed to fluids, such as formation fluids, which may be present within the borehole and that are downhole of the position of a sealing assembly 201 location within the wellbore. In various embodiments, tubular 204, is configured to provide a passageway for fluids, such as formation fluids, to flow in an uphole direction through the tubular, as illustratively represented by arrow 278, in conjunction with the actuation of sealing assembly 201 to sealingly separate a lower annulus 272 from an upper annulus 270 of the wellbore, as further described below.

As shown in FIG. 2, an annular safety valve 216 (valve 216) encircles a portion of tubular 204, and extends in a longitudinal direction along a length of the outer surface 211 of the tubular. Although illustrated in a cross-sectional view in FIG. 2, valve 216 comprises a hollow and generally cylindrical shape that completely encircles tubular 204, having an inner surface 217 of the valve 216 that is in direct physical contact with, and is affixed to, for example by welding or by fasteners, the outer surface 206 of the tubular. Tubular 204 extends through the hollow portion of valve 216 along longitudinal axis 276.

Sealing assembly 201 comprises a stack of components positioned between an upper guide ring 230 and a lower guide ring 240. With respect to the sealing assembly 201 and associated components (such as the guide rings), use of the terms "upper" component or "upper surface" of a component and the terms "lower" component or a "lower surface" of a component refers to relative positioning of components along a direction parallel to the longitudinal axis of the device and/or the longitudinal axis of the wellbore where the components would be located, and does not require that the "upper" component or the "upper surface" of a component is or must be physical positioned at a location closer to the surface of a wellbore compared to the physical positioning of a "lower" component or a "lower surface" of a component. For example, a sealing assembly may be positioned in a portion of the wellbore wherein the longitudinal axis of that portion of the wellbore extends in a horizontal orientation relative to the surface where the wellhead is located, and wherein the sealing assembly may include components referred to as using the terms "upper" component and "lower" component to refer to the relative positioning of these components along the longitudinal axis related to one another, but not necessarily relative to the direction to the surface where the wellhead of the wellbore is located. Further, embodiments of the sealing assembly as illustrated and described herein may be referred to as being "asymmetrical" or as an "asymmetrical sealing assembly" in that compared to conventional sealing assemblies having both an upper and lower sealing element positioned on opposite sides of a intermediate sealing element, the sealing assemblies described herein include only two sealing elements, for example an upper sealing element and a lower sealing element, which are positioned between a pair of guide rings configured to compress the two sealing elements in order to form the fluid seal within a wellbore.

With respect to the sealing assembly 201 and associated components (such as the guide rings), use of the terms "inner" component or "inner surface" of a component and the terms "outer" component or an "outer surface" of a component refers to the positioning of components relative to one another along a radial direction extending perpendicular to the longitudinal axis of the device and/or perpendicular to the longitudinal axis of the wellbore where the components would be located. For example, an "inner surface" of a component may be positioned closer to a longitudinal axis of the sealing assembly or to the longitudinal axis of that portion of the wellbore where the sealing assembly is to be positioned, compared to the position of a "outer surface" of the component, which may be position farther in a radial direction from the longitudinal axis of the sealing assembly or from the longitudinal axis of the portion of the wellbore were the sealing assembly is to be positioned. In various embodiments, an "inner surface" of a component of a sealing assembly is configured to face toward the longitudinal axis of the sealing component, and an "outer surface" of a component of the sealing assembly is configured to face toward the inner surface of a wellbore or an inner surface of a borehole casing position within a wellbore at a position within the wellbore where the sealing assembly is to be actuated to form a fluid seal.

Referring again to sealing assembly 201, in various embodiments the stack of components includes an upper shoe 232 positioned adjacent to the upper guide ring 230, an upper sealing element 234 positioned lower from and adjacent to the upper shoe, a spacer 236 positioned lower from and adjacent to the upper sealing element, a lower sealing element 238 positioned lower from and adjacent to the spacer, and a lower guide ring 240 positioned lower from and adjacent to the lower sealing element. In various embodiments, the upper guide ring 230 and the lower guide ring 240 are formed from a rigid material, such as a metal material, for example stainless steel. As further described below, a length defining a spacing in the longitudinal direction between the upper guide ring 230 and the lower guide ring 240 may be shortened in order to reduce the longitudinal spacing between these guide rings, thereby compressing the upper sealing element 234 and the lower sealing element 238, which in various embodiments are formed from an elastic type of material, such as a rubber or other material that may be compressed in order to deform the shape of these sealing elements.

When compressed between the upper guide ring 230 and the lower guide ring 240, both upper sealing element 234 and lower sealing element 238 are configured to deform in a manner that expands the outer facing surfaces of these sealing elements in a direction away from the outer surface 211 of the valve 216, and toward the inner surface 207 of casing 202. When fully compressed, sealing elements 234 and 238 are compressed against the inner surface 207 of the casing 202 with an adequate amount of force to form a fluid seal between the area(s) included in annulus 270 (located uphole from sealing assembly 201), and the area(s) included in annulus 272 (located downhole from sealing assembly 201). In various embodiments, lower sealing element 238 may include an open cavity 237, which may or may not also include an additional sealing ring, and which is positioned along the inner surface 256 of the sealing element. Cavity 237 and the combination of cavity 237 and an additional sealing ring, when provided as part of sealing element 238, may be configured to alter the way sealing elements expands and is distorted during actuation of the sealing assembly 201, as further described below with respect to FIGS. 4A-4B and 5A-5B.

In the embodiments as illustrated in FIG. 2, upper guide ring 230 is fixed in position longitudinally relative to valve 216. The upper guide ring 230 is in direct physical contact with an uphole facing surface of upper shoe 232. An inner surface of upper shoe 232 extends from the outer surface 211 of valve 216 and along and in direct physical contact with upper surface 250 of the upper sealing element 234. The inner surface of the upper shoe 232 includes a portion of the upper shoe that extends over the upper sealing element 234 along and in direct physical contact with the outer surface 252 of the upper sealing element 234. An uphole facing surface of spacer 236 in positioned to be in direct physical contact with a lower surface 253 of the upper sealing element 234. A downhole facing surface of spacer 236 is positioned to be in direct physical contact with an upper surface 254 of the lower sealing element 238. As such, spacer 236 is configured to separate the upper sealing element 234 from being in direct physical contact with the lower sealing element 238 when the sealing assembly is in the unactuated position as illustrated in FIG. 2. Spacer 236 may have an uneven or lopsided mushroom shape in cross-section, wherein the stem portion of the spacer extends to be in direct physical contact with the outer surface 211 of the valve 216, and wherein the head portion of the spacer extends outward in longitudinal directions from the stem portion of the spacer. The shape of the head portion of the spacer is configured to help direct the deformation of both the lower surface 253 of the upper sealing element 234 and the upper surface 254 of the lower sealing element 238 when the sealing assembly 201 is actuated, thus urging the sealing surfaces of both the upper and lower sealing elements to extend toward the inner surface 207 of casing 202 and to form the desired fluid seal between the valve 216 and the inner surface 207 of the casing 202.

A lower surface 257 of the lower sealing element 238 in the embodiments illustrated in FIG. 2 is configured to be in direct physical contact with an upper surface 241 of the lower guide ring 240. The lower guide ring 240 is configured to be actuated to move in a uphole direction, as further described below, so that the upper surface 241 applies a compressive force against the lower surface 257 of the lower sealing element 238. The compressive force applied to the lower sealing element 238 is transferred through the lower sealing element 238, through the spacer 236, and to the upper sealing element 234 and upper shoe 232. Because upper guide ring 230 is fixedly attached to the outer surface 211 of valve 216, the compressive force applied by the lower guide ring 240 results in the compression of the upper sealing element 234, along with movement of the spacer 236 in an uphole direction, and compression and upward movement of the lower sealing element 238. The combination of the movement and compression of these elements results in the upper shoe 232, the upper sealing element 234, and the lower sealing element 238 being bent and/or deformed in a manner that causes the upper and the lower sealing elements to extend and fill the space between the outer surface of the valve 216 and the inner surface 207 of the casing 202, thereby forming a fluid seal between the outer surface 211 of the valve 216 and the inner surface 207 of the casing 202 along the portion of the tubular 204 adjacent to the sealing assembly.

In various embodiments, a nominal dimension for the outside diameter of the sealing assembly in cross section, (i.e., along axis 274 perpendicular to longitudinal axis 276), is 9.20 inches. Sealing assembly 201 may be configured to seal an internal wellbore cavity having an inside diameter in cross-section (i.e., along axis 274 perpendicular to longitudinal axis 276), in a range of 9.606 to 9.818 inches, inclusive. In various embodiments, upper sealing element 234 has a height dimension, i.e., a maximum dimension parallel to or along inner surface 251 between upper surface 250 and lower surface 253), in a range of 1.00 to 3.00 inches, inclusive, and a thickness dimension, (i.e., a maximum dimension perpendicular to longitudinal axis 276 between inner surface 251 and outer surface 252) in a range of 0.25 to 2.00 inches, inclusive. In various embodiments, lower sealing element 238 has a height dimension, (i.e., a maximum dimension parallel to or along inner surface 256 between upper surface 254 and lower surface 257) in a range of 1.0 to 6.0 inches, inclusive, and a thickness dimension, (i.e., a maximum dimension perpendicular to longitudinal axis 276 between inner surface 256 and outer surface 255) in a range of 0.25 to 2.00 inches, inclusive.

Prior to actuation of the sealing mechanism and once the valve 216 and the sealing assembly 201 are positioned within the casing 202 at the desired location, a locking mechanism may be first actuated to secure the valve 216 and the sealing assembly 201 at a fixed position within the casing 202. As a non-limiting example, the valve 216 in FIG. 2 includes a set of locking teeth 220. Locking teeth 220 may be configurable to be positioned in a recessed position when the tubular 204 including the valve 216 and the sealing assembly 201 is being lowered into position within the casing 202. Once in the desired potion, locking teeth 220 may be actuated, for example using actuation mechanism 222, to cause the locking teeth to extend outward from the recessed position to a locking position ,wherein the locking teeth are configured to contact and physically engage the inner surface 207 of the casing in a matter that secures the valve 216 and the sealing assembly 201 from moving longitudinally, and in some embodiments, for rotating around the longitudinal axis 276. Actuation mechanism 222 is not limed to any particular type of actuator mechanism, and in various embodiments may include a piston that is mechanically coupled to the locking teeth 220, the piston configured to be moved using hydraulic or pneumatic pressure, for example as provided from fluid passageway 208, to actuate the locking teeth into the locking position. Once in the locking teeth 220 have been actuated into the locking position, the locking teeth and the actuation mechanism 222 may be configured to maintain the locking teeth in the locking position regardless for example of any changes in the fluid pressure provided to actuation mechanism 222.

Once the valve 216 and sealing assembly 201 have been secured in place at the desired location within the casing 202, sealing assembly 201 may be actuated in order to compress the sealing assembly, and thereby form the fluid seal between the outer surface 211 of the valve 216 and the inner surface 207 of the casing. Actuation of the sealing assembly 20 to cause the sealing assembly to form the fluid seal is not limited to any particular mechanism, or to any particular method of actuation. As a non-limiting example, as shown in FIG. 2 the lower guide ring 240 is configurable to be moveable longitudinally relative to a guide ring retainer 242. A portion of guide ring retainer 242 extends over the outer surface of the lower guide ring 240, while another portion of the guide ring retainer is affixed to the outer surface of valve 216, thus retaining the lower guide ring in contact with the outer surface 211 of valve 216. In various embodiments, the longitudinal portion of the lower guide ring 240 within the guide ring retainer 242 is maintained by a retention mechanism 244, which in various embodiments is a shear pin.

A lower end of the lower guide ring 240 may to positioned adjacent to a cavity 243 located within the portion of the guide ring retainer 242 that does not extend over the lower guide ring. Cavity 243 m in fluid communication with the fluid passageway 208 extending through valve 216, for example through fluid passageway 219. Fluid pressure provided within fluid passageway 208 may be provided to cavity 243 through fluid passageway 208. The fluid pressure provided to cavity 243 is further applied to the lower surface of the lower guide ring 240. When an adequate level of pressure is present within cavity 243, retention mechanism 244 is released, for example by shearing of a shear pin, thru releasing the lower guide ring 240, and allowing the pressure in cavity 243 to be exerted on the lower guide ring to urge the lower guide ring to extend from the lower guide ring retainer 242 in an uphole direction. The uphole movement of the lower guide ring 240 is transferred to the lower sealing element 238, and thereby to the other components of the sealing assembly 201, including the upper sealing element 234, as described above.

The movement and compressive force exerted on the components of the sealing assembly by virtue of the upward movement of the lower guide ring 240 is thereby used to actuate the sealing assembly 201, and to form the seal between the outer surface 211 of the valve 216 and the inner surface 207 of casing 202. By controlling the pressure provided to the fluid passageway 208, and thus to cavity 243, the time when the sealing assembly 201 is actuated to form the seal can be determined and controlled. Although movement associated with the guide rings 230 and 240 is illustrated and described with respect to FIG. 2 as having the upper guide ring 230 fixed in position and the lower guide ring 240 as being movable, alternative embodiments may include having the lower guide ring 240 fixed and the upper guide ring 230 configured as movable, or in other embodiments having both the upper guide ring and the lower guide ring configured as moveable.

Once the sealing mechanism 201 has been actuated, any fluid pathway between annulus 270 and annulus 272 through the area occupied by the sealing assembly 201 is blocked off. A pathway for the flow of fluid, and thus for applying fluid pressure to the area of annulus 272, may be controllably provided around sealing assembly 201 through valve 216. As shown in FIG. 2, valve 216 includes a fluid inlet 210 that is may be controllably put into fluid communication with the fluid passageway 208. Control of the coupling between fluid inlet 210 and fluid passageway 208 may be opened or blocked by a stopper mechanism 209. In various embodiments, when stopper mechanism 209 is actuated, a pathway for fluid to flow and fluid pressure to be provided from fluid inlet 210 to fluid passageway 208 may be provided. When stopper mechanism is not actuated, the stopper mechanism may default to a closed position, for example using a mechanical urging mechanism, such as a spring, that causes the stopper mechanism to block off the connection between the fluid inlet 210 and the fluid passageway 208.

When stopper mechanism 209 is actuated, fluid pressure present in annulus 270 may provide a flow of fluid into fluid inlet 210, and through fluid passageway 208 in a downhole direction through the valve 216, and then exiting the valve 216 by fluid outlet 214 and into the area included in annulus 272. Thus, fluid flow including a fluid pressure provided to the area of annulus 272, for example from the surface of the borehole, may pass through valve 216, and into annulus 272. The fluid flow/fluid pressure applied to annulus 272 may generate an upward pressure, and thus an upward flow of fluid from downhole within the borehole, and upward through tubular 204 past sealing assembly 201, as illustratively represented by arrow 278. The flow of fluids from areas below the seal assembly 201 and in fluid communication with annulus 272 are prevented from flowing back up though the borehole around the outside of valve 216 by virtue of the fluid seal provided between the valve 216 and the inner surface 207 of the casing 202 by sealing assembly 201.

When a level of pressure applied by the areas included in annulus 270 is reduced to a pressure level that is less than the pressure level present in the area including annulus 272, stopper mechanism 209 can be deactivated or otherwise configured to block off the fluid pathway(s) between fluid inlet 210 and fluid passageway 208, thus preventing any fluid flows occurring from annulus 272 back through the valve 216 to annulus 270, while sealing assembly 201 prevents any fluid flows from occurring from annulus 272 back to annulus 270 around the outside of valve 216. As such, the pressure present in the areas of annulus 272, and therefore the pressure present in the portions of the borehole downhole from sealing assembly 201, may be controlled by control over the pressure applied to annulus 270 in conjunction with control of the operation of valve 216.

Figure 3:
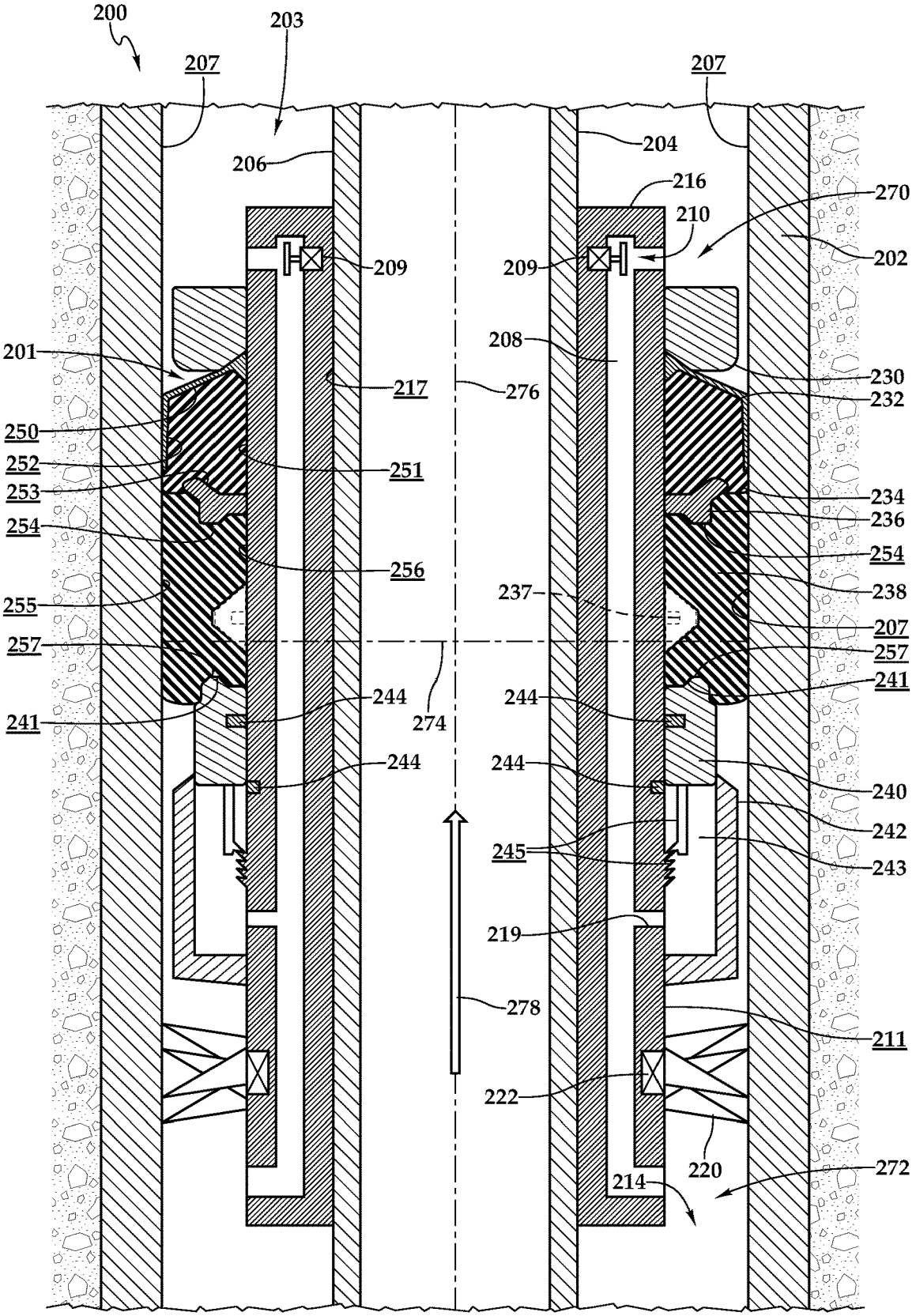
FIG. 3 illustrates cutaway view of a portion of the wellbore including a sealing assembly positioned within a wellbore of FIG. 2, wherein the sealing assembly has been actuated to the sealing configuration, according to various embodiments.

FIG. 3 illustrates cutaway view of a portion of the wellbore 200 including the sealing assembly 201 positioned within a wellbore of FIG. 2, wherein the sealing assembly 201 has been actuated to the sealing configuration, according to various embodiments. As shown in FIG. 3, the lower guide ring 240 has been extended outward from the lower guide ring retainer 242, and thereby providing a compressive force on the lower surface 257 of the lower sealing element 238. The extension of the lower guide ring 240 in various embodiments resulted from fluid pressure provided to cavity 243 increasing to a level adequate to cause the release of retention mechanism 244, for example by searing of the retention mechanism 244, and thereby allowing the lower guide ring 240 to move in an uphole direction. The advancement of the position of the lower guide ring, and thus the application of the compressive force on the lower sealing element 238, is maintained by having the latching mechanism 245 lock, in some embodiments in incremental steps, to prevent the lower guide ring 240 from retreating back into the lower guide ring retainer 242 once the lower guide ring has been extended.

As illustrated in FIG. 3, the compressive force applied by the lower guide ring 240 against the lower surface 257 of the lower sealing element 238 has resulted in a deformation and compression of the lower sealing element, resulting in some or all of the outer surface 255 of the lower sealing element having expanded outward to make direct physical contact with the inner surface 207 of the casing 202. In addition, the compressive force applied to the lower sealing element 238 has been transferred through the lower sealing element to the spacer 236. Spacer 236 is configured to move upward longitudinally, and to transfer compressive forces applied to the spacer by the lower sealing element 238 to the lower surface 253 of the upper sealing element 234. The compressive forces applied by spacer 236 to the lower surface 253 of upper sealing element 234 are transferred to upper shoe 232. However, because the upper guide ring 230 is affixed to the outer surface 211 of valve 216, any compressive forces applied through the spacer 236 to the upper sealing element 234 will result in compression of the lower sealing element, and some bending of the upper shoe 232, along with deformation of some portion of the upper shoe 232 and the upper sealing element 234 to expand the components outward to make direct physical contact with the inner surface 207 of the casing 202.

As shown in FIG. 3, at least some portion of the upper shoe 232 that extends along the outer surface 252 of the upper sealing element 234, along with at least some portion of the outer surface 252, is in direct contact with the inner surface 207 of the casing 202. As further shown in FIG. 3, an inner surface 256 of the lower sealing element 238, along with an inner surface 251 of the upper sealing element 234, remained in direct physical contact with the outer surface 211 of valve 216. At least due to the compression and deformation of the upper sealing element 234 and the lower sealing element 238 to become deformed and to expand between and make direct physical contact with both the outer surface 211 of valve 216 and with the inner surface 207 of casing 202, a fluid seal is formed between annulus 270 and annulus 272 that extends between the outer surface 211 of the valve and the inner surface 207 of the casing. Depending on the level of compressive force applied by the lower guide ring 240, some portion of the upper surface 254 of the lower sealing element 238 and some portion of the lower surface 253 of the upper sealing element 234 may overlap the head portion of the spacer 236, and contact one another, thus contributing to the overall sealing capability of the sealing assembly 201 when actuated as shown in FIG. 3.

In various embodiments, outward pressure provided by the compressive force acting on the upper sealing element 234 may provide a sealing pressure exerted on the portion of upper shoe 232 against the inner surface 207 of the casing, and thus contribute to the overall sealing capability of the sealing assembly 201 when actuated as shown in FIG. 3. For example, the presence of the portion of the upper shoe 232, in conjunction with the shape of the upper shoe as extending over the outer surface 252 of the upper sealing element 234, may prevent both the upper sealing element and the lower sealing element from being deformed and to lose the seal between these sealing elements and the casing when a higher level of fluid pressure is present in annulus 272 compared to a level of fluid pressure present in annulus 270. In other words, the positioning and shape of upper shoe 232 may prevent a "blow-out" of the sealing elements 234, 238 that might otherwise occur when a pressure different is present between annulus 272 and annulus 270.

In various emblements, due to the compressive force(s) applied to the lower sealing element 238, some portion of the lower surface 257, and/or some portion of the outer surface 255 of the lower sealing element may be extended out over a portion of the lower guide ring 240, thus contributing to the overall sealing capability of the sealing assembly 201 when actuated as shown in FIG. 3.

FIGS. 4A-4B and 5A-5E illustrate cutaway views, respectively, of a sectional slice of a sealing assembly positioned on an annular safety valve 216 that is positioned within a wellbore casing 202, according to various embodiments. In each of these figures, only one sectional slice of a sealing assembly is illustrated. However, it would be understood that the sealing assembly as illustrated in each of these figures, in its entirety, comprises a generally hollow cylindrical shape that encircles the tubular 204 and the valve 216 for 360 degrees in a radial direction around the longitudinal axis 276 extending along tubular 204, as illustrated in FIG. 2, and wherein each of the sealing assemblies is configured to be actuated to provide a seal between annulus 270 and annulus 272 by virtue of physical contact between surface(s) of the sealing assembly and the inner surface 207 of casing 202. Each of the sealing assemblies as illustrated in FIGS. 4A-4B and 5A-5E may provide any of the features, and be configured to perform any of the functions ascribable to sealing assembly 201 as illustrated and described above with respect to FIG. 2, and/or as ascribable to sealing assembly 130 as illustrated and described above with respect to FIG. 1, with the variations as further described below.

In FIGS. FIGS. 4A-4B and 5A-5E, components having a same reference number as was used in FIG. 2 correspond to a same or similar element or set of elements as illustrated and described with respect to FIG. 2. Further, depending on various factors such as the inner diameter of the wellbore, the material(s) used to form the casing and/or the upper and/or the lower sealing elements of the sealing assembly and/or the overall level of pressures and/or the differential levels of pressure that the sealing assemblies may be configured to seal against/between, the particular embodiments of the sealing assemblies illustrated and described with respect to FIGS. 4A-4B and 5A-5E may be more suitable than other configurations of conventional sealing assemblies for forming the required fluid seal capable of meeting the specific requirements for operating under the conditions and in the location(s) where the sealing assemblies as described herein is/are being deployed.

Figure 4A:
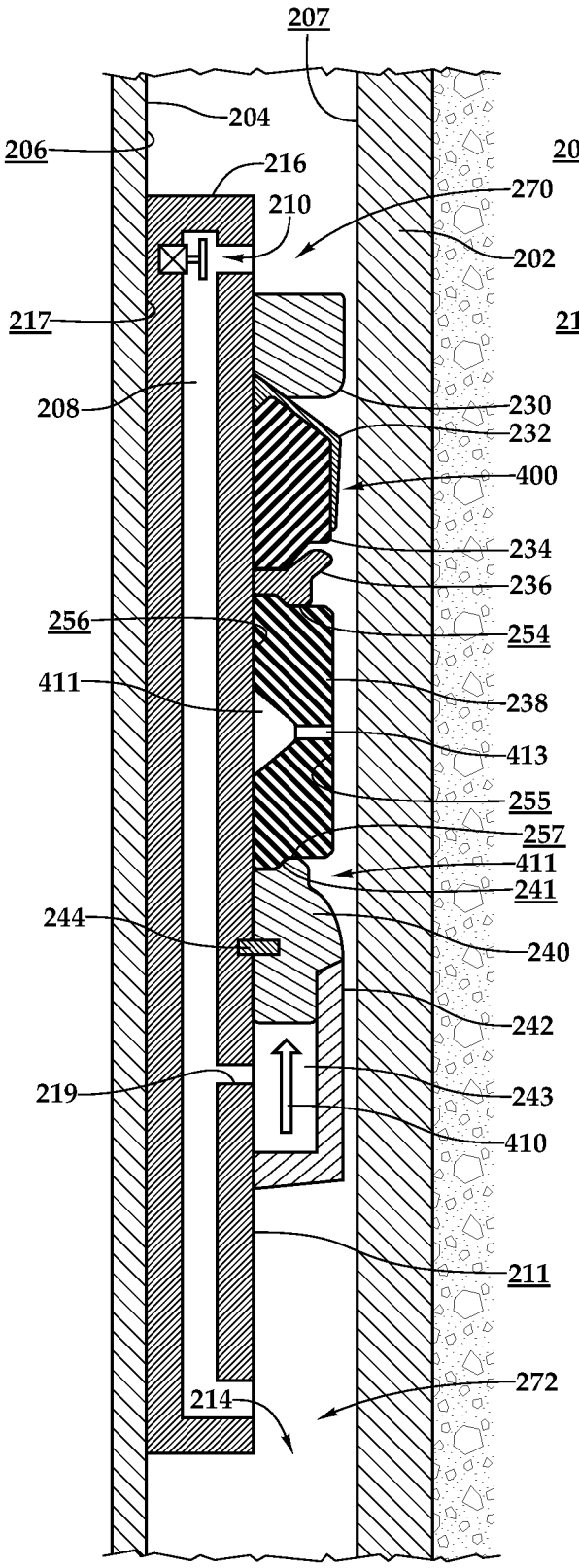
FIG. 4A illustrates a cutaway view of a sectional slice of a sealing assembly positioned within a wellbore casing, according to various embodiments.

FIG. 4A illustrates a cutaway view of a sectional slice of a sealing assembly 400 positioned within a wellbore casing 202, according to various embodiments. Sealing assembly 400 may include all or some combination of the elements described above with respect to sealing assembly 201 (FIG. 2), and be configured to perform any or all of the functions and provide any or all of the features ascribable to sealing assembly 201, and any equivalents thereof. Variations included in the sealing assembly 400 compared to sealing assembly 201 (FIG. 2) comprise a lower sealing element 238 that includes a cavity 411 extending along a portion of inner surface 256. In various embodiments, cavity 411 may be positioned at about the midpoint along inner surface 256, and may extend away from inner surface 256 toward, but not extending to, the outer surface 255 of the lower sealing element. The shape of cavity 411 in cross-section is not limited to a particular shape, and in various embodiments may take the shape of a truncated pyramid having the base of the truncated pyramid extending along inner surface 256 in a direction that is parallel to the direction of the longitudinal axis 276 (FIG. 2). Other shapes for cavity 411 in cross-section, such as semi-circular, triangular, arcuate, etc., are contemplated for use as the shape of cavity 411 prior to actuation of sealing assembly 400.

In various embodiments, cavity 411 extends in a radial direction around and encircles the entirety of the lower sealing element 238, thereby forming a groove extending around the inner surface 256 of the lower sealing element 238. The shape and positioning of cavity 411 are configured to allow lower sealing element 238 to fold and compress in a manner that aids in at least some portions or all of outer surface 255 of the lower sealing element to extend toward and make sealing contact with the inner surface 207 of casing 202. In addition, the shape of the upper surface 241 of the lower guide ring 240 may be positioned adjacent to and in direct contact with the lower surface 257 of the lower sealing element 238 such that when the sealing assembly 400 is actuated, portions of the lower sealing element, including potions of lower surface 257 and/or portions of outer surface 255 of the lower sealing element may be extruded into a space 415 and extend over a portion of the lower guide ring 240. In various embodiments, the extrusion of some portion of the lower sealing element 238 into space 415 may provide a larger surface area of contact available for forming a seal between lower sealing element 238 and the inner surface 207 of casing 202 when sealing assembly 400 is actuated, as illustratively represented by arrow 410.

In various embodiments, one or more vent tubes 413 may be positioned at various locations radially around the lower sealing element 238. Each of the vent tubes 413 extends between cavity 411 and the outer surface 255 of the lower sealing element. The number and/or the location of the vent tubes 413 is not limited to a particular number of vent tubes, or to a particular arrangement of the spacing of the vent tubes, which may be space evenly, unevenly, and/or in the alternative in groups that are evenly or unevenly spaced relative to one another in a radial direction around the lower sealing element 238. The one or more vent tubes 413 may be configured to provide a fluid passageway between cavity 411 and the area proximate to outer surface 255 of the lower sealing element 238 in order to allow fluid pressure formed within cavity 411 during the actuation of the sealing assembly 400 to escape cavity 411, thus enabling the compression, and in some embodiments, the full collapse of the space within cavity 411. As such, during actuation of sealing assembly 400 the lower sealing element 238 may be bowed out at the center of so that the seal between the lower sealing element and the inner surface 207 of the casing 202 is first made at the center of the outer surface 255, and then extended to include contact between the end portions of the outer surface 255, which in various embodiments may lead to less resistance occurring between the outer surface 255 of the lower sealing element 238 and the inner surface 207 of the casing 202, and thus a better seal being formed by the sealing assembly 400.

Figure 4B:
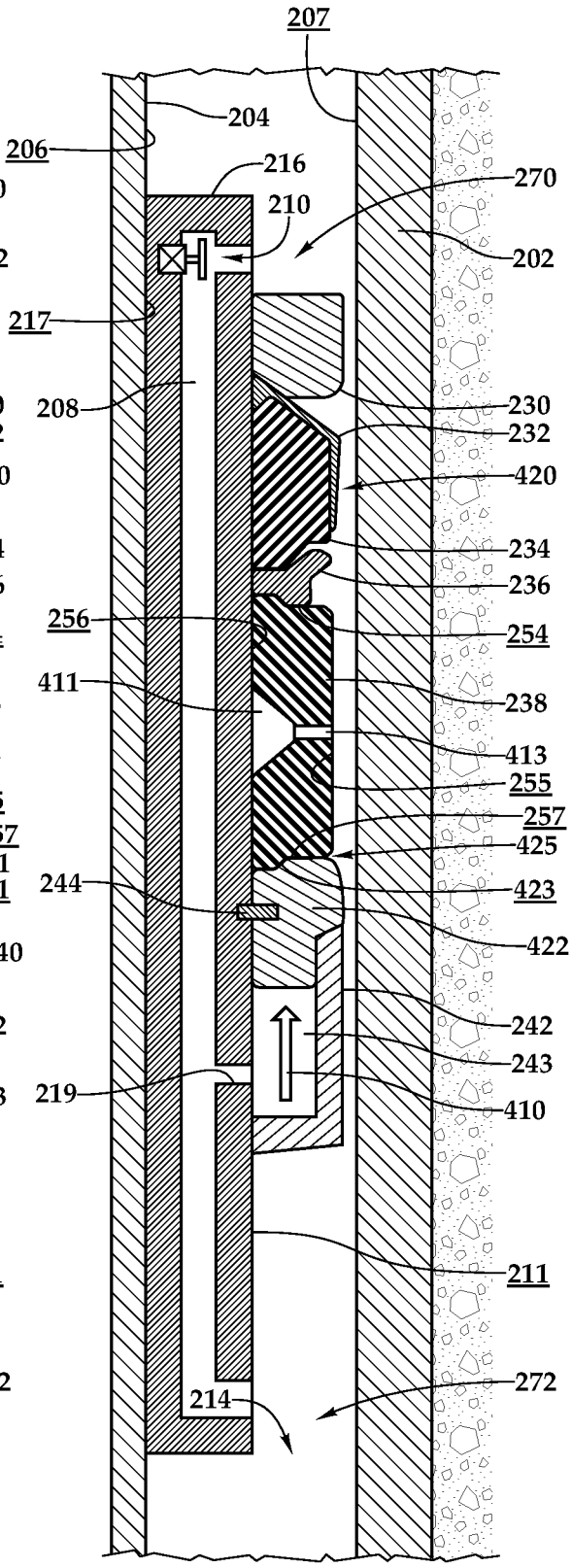
FIG. 4B illustrates a cutaway view of a sectional slice of a sealing assembly positioned within a wellbore casing, according to various embodiments.

FIG. 4B illustrates a cutaway view of a sectional slice of a sealing assembly 420 positioned within a wellbore casing 202, according to various embodiments. Sealing assembly 420 may include all or some combination of the elements described above with respect to sealing assembly 201 (FIG. 2), and/or the elements described above with respect to sealing assembly 400 (FIG. 4A), including cavity 411 and vent tubes 413. Embodiments of sealing assembly 420 may be configured to perform any or all of the functions and to provide any or all of the features ascribable to sealing assembly 201 (FIG. 2), and/or ascribable to sealing assembly 400 (FIG. 4A), and any equivalents thereof. Variations included in the sealing assembly 420 compared to sealing assembly 400 (FIG. 4A) comprise a lower guide ring 422 having an upper surface 423 that extends away from outer surface 211 of valve 216 to a level approximately equal to or greater than the level of outer surface 255 of the lower sealing element 238. Upper surface 423 of the lower guide ring 422 may have an upright angle perpendicular to the longitudinal axis 276 extending to a radius corner extending to an outer surface of the lower guide ring facing the inner surface 207 of casing 202. The upright shape of the upper surface 423 may extend along the lower surface 257 of the lower sealing element 238 to a position nearer the outer surface 255 of the lower sealing element as compared to the areas of contact between the upper surface 241 of the lower guide ring 240 of FIG. 4A, so that the space 425 present between the lower guide ring 422 and the lower surface 257 of the lower sealing element 238 is smaller, prior to actuation of sealing assembly 420, compared to the space 415 available in the version of sealing assembly 400 (FIG. 4A). As a result, the sealing assembly 420 as illustrated and described with respect to FIG. 4B may allow for a greater level of compressive force to be applied by the lower guide ring 422 to the lower sealing element 238 as a result of not allowing the lower sealing element 238 to be extruded into and extend over the lower guide ring 240. This smaller area provided by space 425 may result in a greater level of sealing force to be generated by the sealing assembly 420 when actuated for a given level of fluid pressure applied to cavity 243, and thereby providing a fluid seal having a higher maximum pressure rating for sealing annulus 270 from annulus 272.

Figure 5A:
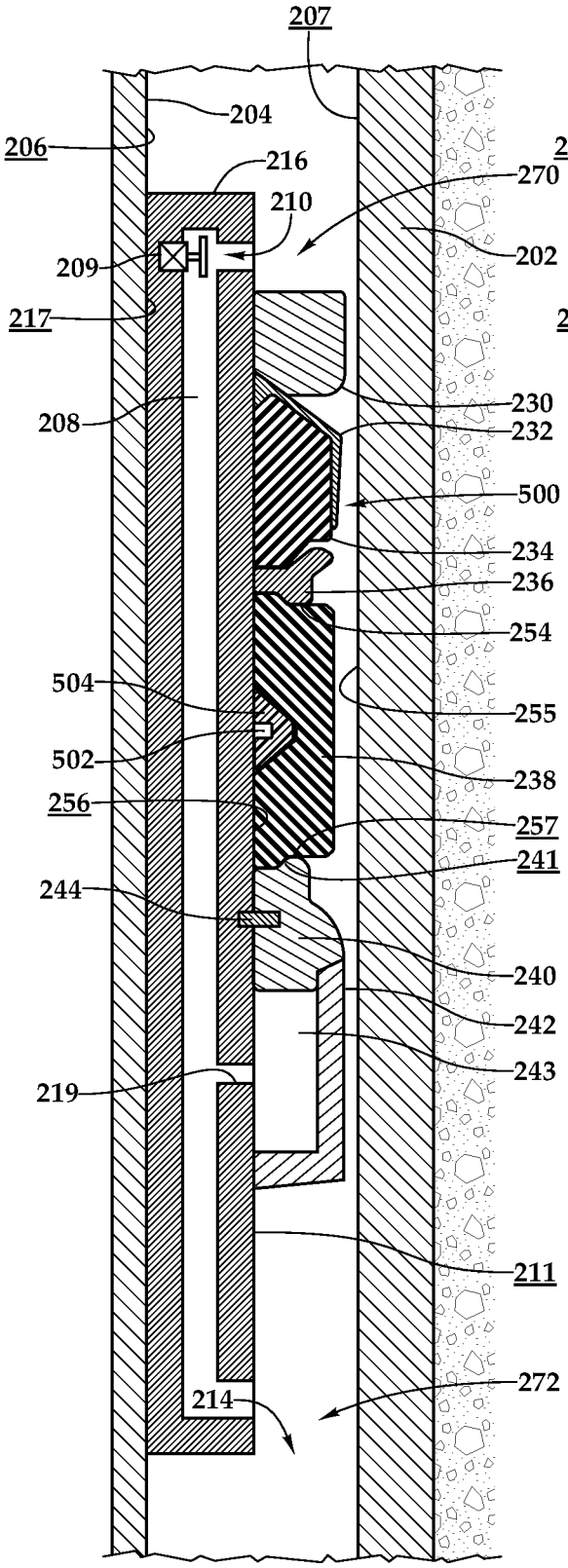
FIG. 5A illustrates a cutaway view of a sectional slice of a sealing assembly positioned within a wellbore casing, according to various embodiments.

FIG. 5A illustrates a cutaway view of a sectional slice of a sealing assembly 500 positioned within a wellbore casing 202, according to various embodiments. Sealing assembly 500 may include all or some combination of the elements described above with respect to sealing assembly 201 (FIG. 2), and may be configured to perform any or all of the functions and to provide any or all of the features ascribable to sealing assembly 201, and any equivalents thereof Sealing assembly 500 (FIG. 5A) differs from sealing assembly 201 (FIG. 2) in that a reinforcement ring comprising inner ring 502 and a ring cover 504 occupies the space provided as cavity along the inner surface 256 of the lower sealing element 238. The cavity may comprise any of the shape(s) and include any of the characteristics described above with respect to cavity 411 in FIG. 4A. As shown in FIG. 5A, inner ring 502 has a square or rectangular shape in cross-section, having a bottom side surface that is in direct contact with the outer surface 211 of valve 216, and encircles the valve 216 for 360 degrees around the outer perimeter of the valve. In various embodiments, inner ring 502 occupies only a portion of the space available for the reinforcement ring. In addition to the inner ring 502, the reinforcement ring includes a ring cover 504 that extends over the top and side surfaces of the inner ring, and extends to the adjacent surfaces of the cavity, filling the space in cross-section remaining within cavity between the inner ring 502 and the inner surface 256 of the lower sealing element 238. Further, ring cover 504 encircles both the inner ring 502 and the valve 216 for 360 degrees around the outer surface 211 of the valve 216. In various embodiments, when sealing assembly 500 is in the non-activated state as shown in FIG. 5A, the reinforcement ring would occupy the entirety of the cavity provided along the inner surface 256 of the lower sealing element 238.

In various embodiments, when the sealing assembly 500 is actuated, the longitudinal compressive force(s) applied to lower sealing element 238, in conjunction with the sloped or curved shape of the ring cover 504, will urge the portions of the cavity that are proximate to the ring cover 504 to expand outward and away from the reinforcement ring, thus causing the portions of the outer surface 255 of the lower sealing element 238 to extend to and in some embodiments to make direct contact with the inner surface 207 of the casing 202 before the portions of the outer surface 255 that are closer to the upper surface 254 and the lower surface 257 of the lower sealing element 238 extend out to the make contact with the inner surface 207 of the casing. As such, during activation of sealing assembly 500 the lower sealing element 238 may be bowed out at the center of outer surface 255 so that the seal between the lower sealing element 238 and the inner surface 207 of the casing 202 is first made at the center of the outer surface 255, and then extended to include contact between the end portions of the outer surface 255, which in various embodiments may lead to less resistance occurring between the outer surface 255 of the lower sealing element 238 and the inner surface 207 of the casing 202, and thus a better seal being formed by the sealing assembly 500.

Figure 5B:
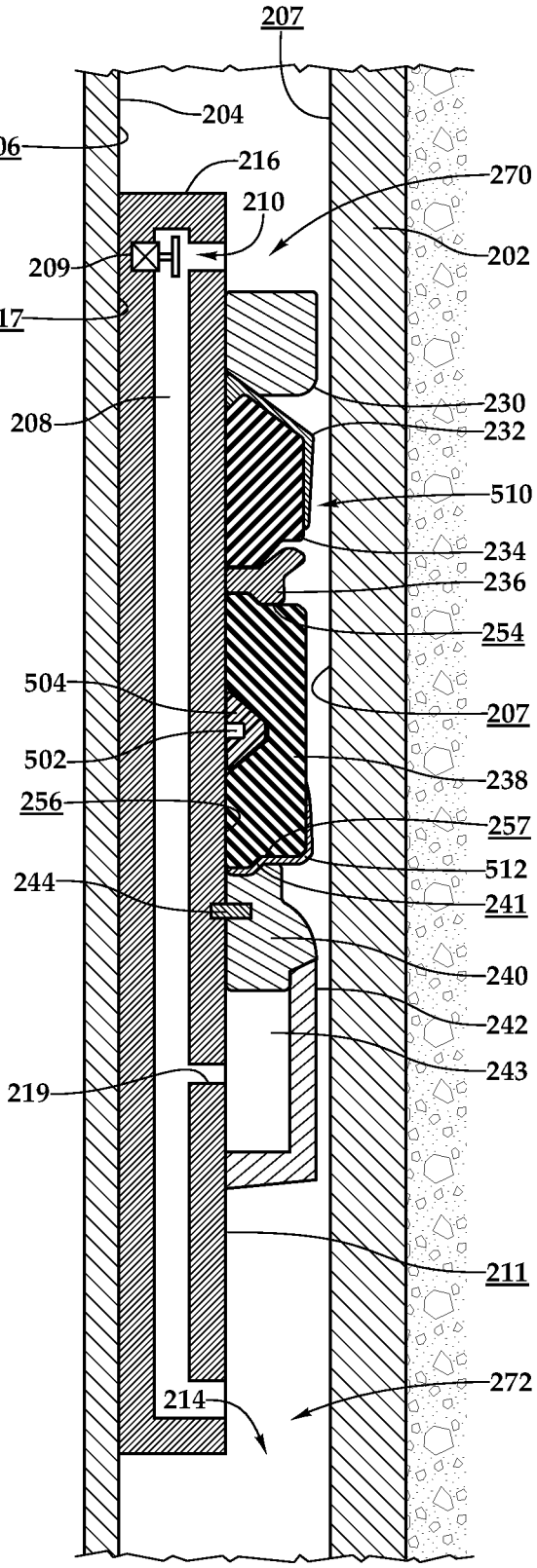
FIG. 5B illustrates a cutaway view of a sectional slice of a sealing assembly positioned within a wellbore casing, according to various embodiments.

FIG. 5B illustrates a cutaway view of a sectional slice of a sealing assembly 510 positioned within a wellbore casing 202, according to various embodiments. Sealing assembly 510 may include all or some combination of the elements described above with respect to sealing assembly 201 (FIG. 2), and may be configured to perform any or all of the functions and to provide any or all of the features ascribable to sealing assembly 201, and any equivalents thereof. Sealing assembly 510 may include all or some combination of the elements described above with respect to sealing assembly 500 (FIG. 5A), and may be configured to perform any or all of the functions and to provide any or all of the features ascribable to sealing assembly 500, and any equivalents thereof Sealing assembly 510 (FIG. 5B) differs from sealing assembly 500 (FIG. 5A) in that a lower shoe 512 has been added to the stack of components forming the sealing assembly 510. As shown in FIG. 5B, lower shoe 512 is positioned adjacent to and between lower sealing element 238 and the lower guide ring 240. In various embodiments, and bottom end of lower shoe 512 is in direct physical contact with the outer surface 211 of valve 216. A portion of the lower shoe 512 extends along the lower surface 257 of the lower sealing element 238, and then bends in an uphole direction to extend along a portion of the outer surface 255 of the lower sealing element. In various embodiments, lower shoe 512 is formed from a bendable material, such as metal, which allows the lower shoe to bend and to be deformed in shape during the actuation of the sealing assembly 510 in order to allow the lower sealing element 238 to expand, for example at the bottom portion of the lower sealing element, and thereby expand outward toward and seal against the inner surface 207 of the casing 202.

Although shown in cross-section in FIG. 5B, it would be understood that the lower shoe 512 encircles the valve 216 in 360 degrees around the outer surface 211 of the valve, and thus also contacts the lower surface 257 of the lower sealing element 238 around the entirety of the lower surface 257 encircling the valve 216. As such, the lower shoe 512 is configured to transmit forces applied for example by lower guide ring 240 through the lower shoe and to the lower sealing element 238, thus helping hold the general shape of the lower surface 257 of the lower sealing element while still allowing the lower sealing element to be compressed and to deformed in an outward direction toward the inner surface 207 of the casing 202. In various embodiments, when fully actuated, the portion of the lower shoe 512 that is adjacent to the lower surface 257 of the lower sealing element 238 may be moved outward to the point of making direct physical contact with the inner surface 207 of the casing 202, and thereby help to reduce or eliminate the extrusion of the lower surface 257 of the lower sealine element out over some portion of the lower guide ring 240. Depending on various factors such as the inner diameter wellbore, the material(s) used to form the casing, the upper and/or the lower seals of the assembly, and/or the level of pressure and/or the differential level of pressure that the sealing assembly 510 is configured to seal against/between, the embodiments of the sealing assembly 510 may be more suitable for forming the required seal capable of meeting the specific requirements for operating under the conditions and in the location where the seal assembly 510 is being deployed.

Figure 5C:
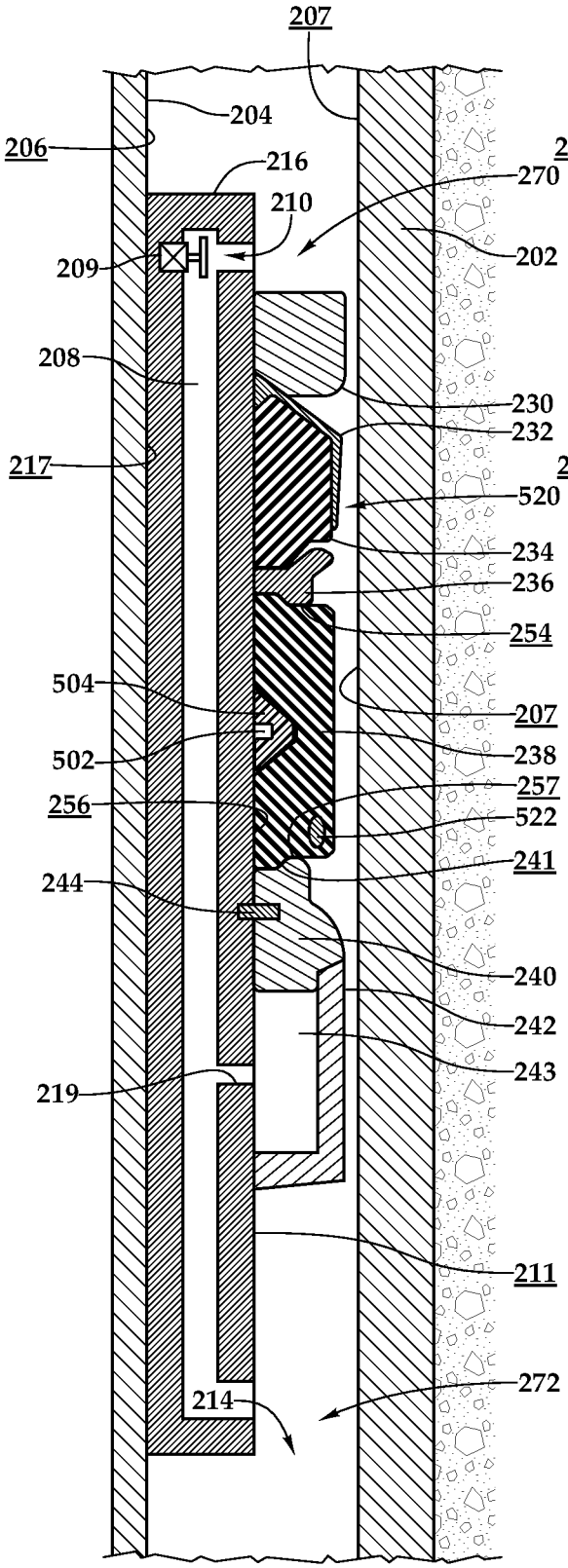
FIG. 5C illustrates a cutaway view of a sectional slice of a sealing assembly positioned within a wellbore casing, according to various embodiments.

FIG. 5C illustrates a cutaway view of a sectional slice of a sealing assembly 520 positioned within a wellbore casing 202, according to various embodiments. Sealing assembly 520 may include all or some combination of the elements described above with respect to sealing assembly 201 (FIG. 2), and may be configured to perform any or all of the function and provide any or all of the features ascribable to sealing assembly 201, and any equivalents thereof. Sealing assembly 520 may include all or some combination of the elements described above with respect to sealing assembly 500 (FIG. 5A), and may be configured to perform any or all of the function and provide any or all of the features ascribable to sealing assembly 500, and any equivalents thereof.

Sealing assembly 520 (FIG. 5C) differs from sealing assembly 201 (FIG. 2) in that the lower sealing element 238 includes a reinforcement ring 522 embedded with the material forming the lower sealing element 238. In various embodiments, reinforcement ring 522 is formed of a material, such as metal. In various embodiments, reinforcement ring 522 is a solid rod shaped material that forms a closed ring shape the encircles the valve 216 and extends for 360 degrees around longitudinal axis 276 (FIG. 2). In various embodiments, reinforcement ring 522 comprises a solid rod shape that itself has another wire shaped material forming a winding around and extending along the entirety of the solid rod shape. In various embodiments, reinforcement ring 522 may be circular, elliptical, rounded square, rounded rectangle, or some other closed polygonal shape in cross-section. In various embodiments, reinforcement ring 522 is positioned proximate the corner where lower surface 257 and outer surface 255 of the lower sealing element 238 join together, but positioned below both of these surfaces and embedded within the material forming the lower sealing element 238.

In various embodiments, when sealing assembly 520 is actuated, the reinforcement ring 522 may stiffen and strengthen the corner of the lower sealing element 238 in the area proximate to the corner were the lower surface 257 and the outer surface 255 of the lower sealing element come together, thereby limiting the amount of the lower sealing element that may be extruded over the lower guide ring 240, and also strengthening the seal made between the outer surface 255 of the lower sealing element 238 and the inner surface 207 of the casing 202. The reinforcement ring 522, when provided, may allow sealing assembly 520 to provide a seal configured to withstand a higher pressure differential between annulus 270 and annulus 272 once the sealing assembly 520 is actuated within the casing 202.

Figure 5D:
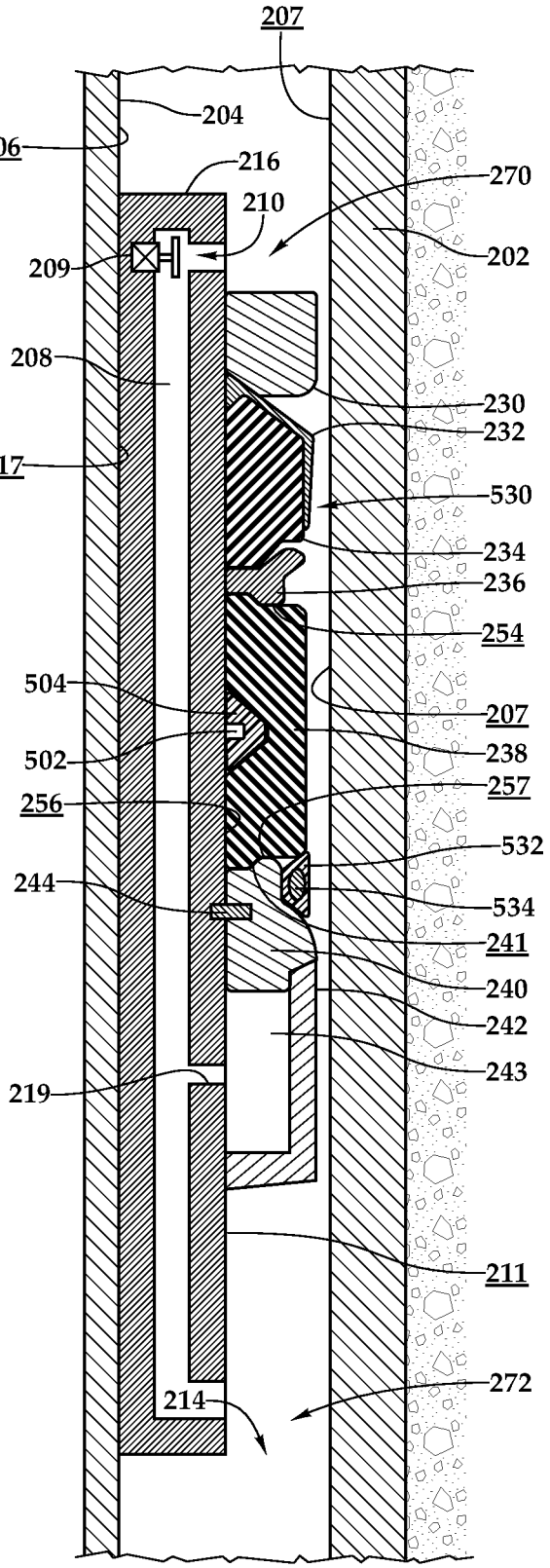
FIG. 5D illustrates a cutaway view of a sectional slice of a sealing assembly positioned within a wellbore casing, according to various embodiments.

FIG. 5D illustrates a cutaway view of a sectional slice of a sealing assembly 530 positioned within a wellbore casing 202, according to various embodiments. Sealing assembly 530 may include all or some combination of the elements described above with respect to sealing assembly 201 (FIG. 2), and may be configured to perform any or all of the function and provide any or all of the features ascribable to sealing assembly 201, and any equivalents thereof. Sealing assembly 530 may include all or some combination of the elements described above with respect to sealing assembly 500 (FIG. 5A), and may be configured to perform any or all of the function and provide any or all of the features ascribable to sealing assemblies 500, and any equivalents thereof.

Sealing assembly 530 (FIG. 5D) differs from sealing assembly 201 (FIG. 2) in that sealing assembly 530 includes a wedge 532 comprising a reinforcement ring 534 embedded within the wedge 532. As shown in FIG. 5D, wedge 532 may be a shape in cross-section, such as a truncated pyramid, which generally conforms to the shape of a space above an upper portion the lower guide ring 240 that extends out beyond the guide ring retainer 242 before the sealing assembly 530 is actuated. Wedge 532 is configured to form a closed ring shape that encircles the area above the upper portion of the lower guide ring 240 for 360 degrees around the valve 216. In various embodiments, wedge 532 is form from a rigid material, such as a hard plastic such as Polytetrafluoroethylene (PTFE). In various embodiments, reinforcement ring 534 is formed from a material, such as metal, and extends in a ring shape embedded within the material forming wedge 532, wherein the reinforcement ring 534 extents for 360 degrees around and within the entirety of the wedge 532. In various embodiments, reinforcement ring 534 is a solid rod shaped material that forms a closed ring shape. In various embodiments, reinforcement ring 534 comprises a solid rod shape that itself has another wire shaped material forming a winding around and extending along the entirety of the reinforcement ring. In various embodiments, reinforcement ring 534 may be circular, elliptical, a rounded square, a rounded rectangle, or some other closed polygonal shape in cross-section. In various embodiments, when sealing assembly 530 is actuated, the wedge 532, in conjunction with the reinforcement ring 534, may act to limit or to completely eliminate the lower portion of the lower sealing element 238 from being extruded over the upper portion(s) of the lower guide ring 240. As a result, the sealing assembly 530 may allow for a greater level of compressive force to be applied by the lower guide ring 240 to the lower sealing element 238 by not allowing the lower sealing element 238 to be extruded into and extend over the lower guide ring 240, and thereby provide a greater level of sealing force to be generated by the sealing assembly 530 when actuated for a given level of fluid pressure applied to cavity 243, thus providing a fluid seal having a higher maximum pressure rating for sealing the annulus 270 from annulus 272.

Figure 5E:
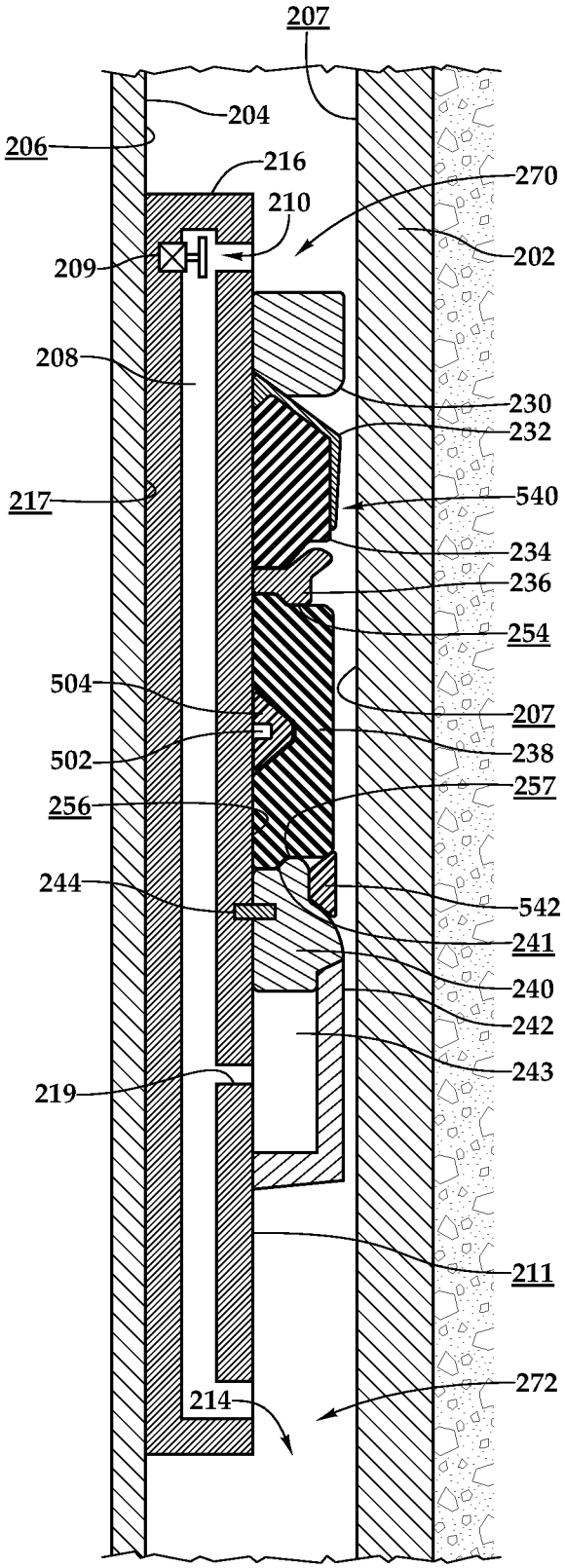
FIG. 5E illustrates a cutaway view of a sectional slice of a sealing assembly positioned within a wellbore casing, according to various embodiments.

FIG. 5E illustrates a cutaway view of a sectional slice of a sealing assembly 540 positioned within a wellbore casing 202, according to various embodiments. Sealing assembly 540 may include all or some combination of the elements described above with respect to sealing assembly 201 (FIG. 2), and may be configured to perform any or all of the function and provide any or all of the features ascribable to sealing assembly 201, and any equivalents thereof. In addition, sealing assembly 540 may include all or some combination of the elements described above with respect to sealing assembly 530 (FIG. 5D), and may be configured to perform any or all of the function and provide any or all of the features ascribable to sealing assembly 530, with the difference being that wedge 542 in sealing assembly 540 lacks a reinforcement ring as is included in the wedge 532 of the sealing assembly 530 (FIG. 5D).

Figure 6:
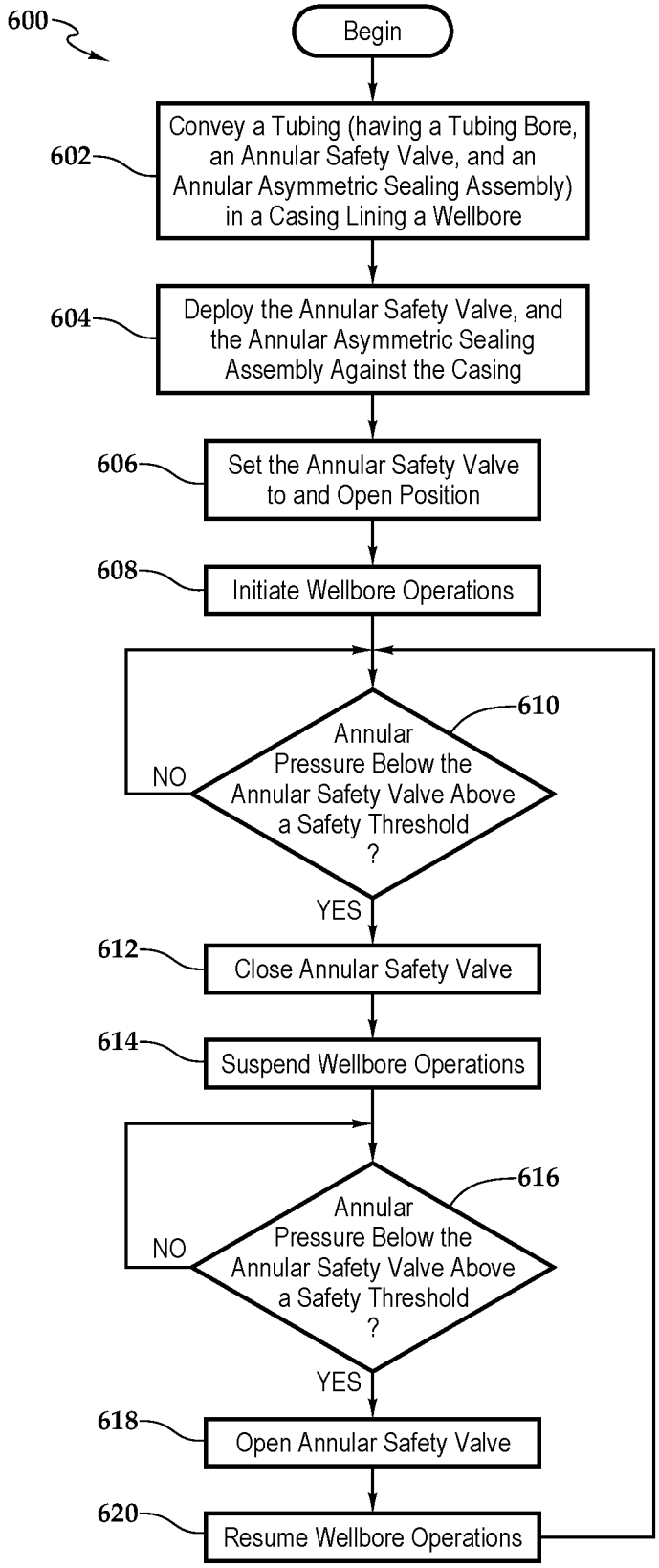
FIG. 6 illustrates a flowchart of a method, according to various embodiments.

FIG. 6 depicts a flowchart of a method 600, according to various embodiments. Operations included in method 600 may include operations performed on a wellbore system such as the wellbore operating environment 100 as illustrated and describe with respect to FIG. 1. Operations included in method 600 may include use of any embodiments of the two element sealing assemblies as described in this disclosure, or any equivalents thereof. Operations of method 600 begin at block 602 of the flowchart.

At block 602, a tubing (having a tubing bore, an annular safety valve, and an annular asymmetric sealing assembly) is conveyed in a casing lining a wellbore.

At block 604, the annular safety valve and the asymmetric annular sealing assembly are deployed against the casing. In various embodiments, method 600 comprises first deploying a locking mechanism against the casing to physically secure the annular safety valve to a fixed position with the casing followed by deployment of the sealing assembly to form a fluid seal between the outer surface of the annular safety valve and an inner surface of the casing. In various embodiments, the sealing assembly comprises any of the sealing mechanisms described throughout this disclosure, and any equivalents thereof. In various embodiments, actuating the sealing mechanism includes applying a fluid pressure to at least one guide ring of the sealing assembly configured to move the at least one guide ring in a direction that compresses the sealing element of the sealing assembly, and causes the sealing elements to extend outward to contact an inner surface of the casing where the sealing mechanism is located, thereby forming a fluid seal between a tubular element encircled by the sealing assembly and the inner surface of the casing. In various embodiments, the tubular element is an annular safety valve having an outer surface encircled by the sealing assembly. In various embodiments, the tubular element is a section of piping encircled by the sealing assembly.

At block 606, the annular safety valve is set to an open configuration. In the open position, the annular safety valve includes one or more fluid passageways that provide fluid communication between a first annulus within the wellbore that is in fluid communication with one or more areas on an upper side of the fluid seal formed by the sealing assembly and a second annulus with the wellbore that is in fluid communication with one or more areas on a lower side of the fluid seal formed by the sealing assembly.

At block 608, wellbore operations are initiated. In various embodiments, wellbore operations comprise providing fluid pressure to the first annulus area, and having the fluid pressure provided to the second annulus area through the fluid passageways provided by the annular safety valve being set to the open position.

At block 610, a determination is made of whether the annular pressure below the annular safety value is above a safety threshold. If the annular pressure below the annular safety value is above the safety threshold, operations of method 600 continue at block 612. Otherwise, operations of method 600 remain at block 610.

At block 612, the annular safety valve is closed. Closing the annular safety valve comprises configuring the annular safety valve so that any of the fluid passageways extending through the annular safety valve that provided fluid communication between the first annular areas and the second annular area within the wellbore are sealed off so the there is no fluid communication between the first annulus and the second annulus provided through the annular safety valve. In addition, the actuation of the sealing assembly is maintained so that there is no fluid communication between the first annulus and the second annulus around the outer surface of the annular safety valve due to the fluid seal provided by the sealing assembly between the outer surface of the annular safety valve and the inner surface of the casing of the wellbore.

At block 614, wellbore operations are suspended.

At block 616, a determination is made of whether the annular pressure below the annular safety value is below safety threshold. If the annular pressure below the annular safety value is below the safety threshold, operations of method 600 continue at block 618. Otherwise, operations of method 600 remain at block 616.

At block 618, the annular safety valve is opened.

At block 620, after opening the annular safety valve at block 618, wellbore operations are resumed. Operations of method 600 return to operations at block 610.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order.

As used herein, the term "or" is inclusive unless otherwise explicitly noted. Thus, the phrase "at least one of A, B, or C" is satisfied by any element from the set {A, B, C} or any combination thereof, including multiples of any element.

Example embodiments include the following.

Embodiment 1. An apparatus comprising: a sealing assembly comprising a plurality of components including an upper sealing element and a lower sealing element, the sealing assembly configured to encircle a tubular element positioned within a casing of a wellbore and to be actuatable to extend between the tubular element and an inner surface of the casing to form a fluid seal between the tubular element and the inner surface of the casing, wherein the fluid seal is provided using only a set of two sealing elements comprising the upper sealing element and the lower sealing element.

Embodiment 2. The apparatus of embodiment 1, wherein the upper sealing element and the lower sealing element comprise an elastomeric material.

Embodiment 3. The apparatus of embodiments 1 or 2, wherein the sealing assembly further includes a spacer encircling the tubular element and positioned between and separating the upper sealing element from the lower sealing element.

Embodiment 4. The apparatus of embodiment 3, wherein the spacer is formed from a rigid material including metal.

Embodiment 5. The apparatus of any one of embodiments 1-4, wherein the lower sealing element includes a cavity along an inner surface of the lower sealing element, the cavity extending in an outward direction toward but not extending fully to an outer surface of the lower sealing element, the outer surface opposite the inner surface of the lower sealing element.

Embodiment 6. The apparatus of any one of embodiments 1-5, further comprising: an upper shoe positioned adjacent to the upper sealing element, the upper shoe having a shape that conforms to and is in direct physical contact with an upper surface of the upper sealing element, and wherein the upper shoe extends over and is in direct physical contact with a portion of an outer surface of the upper sealing element.

Embodiment 7. The apparatus of any one of embodiments 1-6, wherein the lower sealing element includes a lower surface configured to be positioned in direct physical contact with a lower guide ring, the lower guide ring configured to exert a force in an upward direction on the lower sealing element during actuation of the sealing assembly, the force in the upward direction configured to compress both the upper sealing element and the lower sealing element, causing the upper sealing element and the lower sealing element to be compressed longitudinally and to expand in an outward direction toward the inner surface of the casing of the wellbore.

Embodiment 8. The apparatus of any one of embodiments 1-7, wherein the sealing apparatus is configured to provide the fluid seal between a first annulus of the wellbore and a second annulus of the wellbore having a pressure differential of up to 10,000 pounds/square inch between the first annulus and the second annulus.

Embodiment 9. The apparatus of any one of embodiments 1-8, wherein the lower sealing element further comprises a reinforcement ring that is embedded within a material forming the lower sealing element.

Embodiment 10. The apparatus of any one of embodiments 1-9, wherein the sealing assembly further includes a reinforcement ring positioned proximate to a corner of the lower sealing element adjacent to an outer surface and a lower surface of the lower sealing element, the reinforcement ring comprising a rigid material and configured to prevent one or more portions of the lower sealing element from extruding over an outer surface of a lower guide ring positioned adjacent to the lower surface of the lower sealing element.

Embodiment 11. An apparatus comprising: a sealing assembly comprising a plurality of components including an upper sealing element and a lower sealing element, the sealing assembly configured to encircle an annular safety valve positioned on an tubular element and configured to be lowered into a casing of a wellbore, the sealing assembly configured to be actuatable to extend between an outer surface of the annular safety valve and an inner surface of the casing of the wellbore to form a fluid seal between the outer surface of the annular safety valve and the inner surface of the casing, wherein the fluid seal is provided using a set of only two sealing elements comprising the upper sealing element and the lower sealing element.

Embodiment 12. The apparatus of embodiment 11, wherein the sealing assembly, when actuated, is configured to form the fluid seal separating a first annulus positioned uphole from the sealing assembly from a second annulus positioned downhole from the sealing assembly, and wherein the annular safety valve includes one or more fluid passageways that extend from the first annulus to the second annulus, the one or more fluid passageways configured to be controllably opened to allow fluid pressure provided to the first annulus to be communicated to the second annulus as part of a gas lift operation being performed on the wellbore.

Embodiment 13. The apparatus of embodiments 11 or 12, wherein the sealing assembly includes a lower guide ring having an upper surface adjacent to and in direct physical contact with a lower surface of the lower sealing element, the lower guide ring having a portion extending into a lower guide ring retainer having a cavity adjacent to a lower surface of the lower guide ring, the cavity in fluid communication with a fluid passageway included in the annular safety valve, and wherein the sealing assembly is configured to be actuated when a minimum level of fluid pressure is applied to the cavity causing the lower guide ring to extend from and apply a compressive force to the lower sealing element.

Embodiment 14. The apparatus of any one of embodiments 11-13, wherein the upper sealing element and the lower sealing element comprise an elastomeric material.

Embodiment 15. The apparatus of any one of embodiments 11-14, wherein the sealing assembly further includes a spacer encircling and positioned between and separating the upper sealing element from the lower sealing element.

Embodiment 16. The apparatus of The apparatus of any one of embodiments 11-15, wherein the lower sealing element includes a cavity forming a groove along an inner surface of the lower sealing element, the cavity extending in an outward direction toward but not extending fully to an outer surface of the lower sealing element, the outer surface opposite the inner surface of the lower sealing element, and wherein the cavity includes a retention ring having a ring shape that encircles the inner surface of the lower sealing element.

Embodiment 17. A method comprising: conveying a tubing assembly into a casing of a wellbore, the tubing assembly comprising a tubular string, an annular safety valve encircling the tubular string , and an asymmetrical sealing assembly encircling the annular safety valve, the asymmetrical sealing assembly having a set of only two sealing elements comprising an upper sealing element and a lower sealing element, the asymmetrical sealing assembly configured to be actuatable to extend between an outer surface of the annular safety valve and an inner surface of the casing to form a fluid seal between the tubing assembly and the inner surface of the casing, and deploying the asymmetric sealing assembly in order to form the fluid seal.

Embodiment 18. The method of embodiment 17, initiating operations on the wellbore comprising: setting the annular safety valve to an open position; applying fluid pressure to a first annulus formed within the wellbore and uphole of the position of the asymmetrical sealing assembly, and separated from a second annulus formed within the wellbore and downhole of the position of the asymmetrical sealing assembly; controllably allowing the fluid pressure applied to the first annulus to be provided to the second annulus through one or more fluid passageways provided through the annular safety valve, and monitoring a pressure level in the second annulus.

Embodiment 19. The method of embodiment 18, further comprising: determining that the pressure in the second annulus is above a safety threshold level, and setting the annulare safety valve to a closed position while maintaining the fluid seal between the first annulus and the second annulus using the asymmetrical sealing assembly remaining in an actuated configuration.

Embodiment 20. The method of any one of embodiments 17-19, wherein the asymmetrical sealing assembly comprises an upper guide ring having a lower surface adjacent to and in direct physical contact with an upper surface of the upper sealing element and a lower guide ring having an upper surface adjacent to and in direct physical contact with a lower surface of the lower sealing element, wherein at least one of the upper guide ring and the lower guide ring is configured to be moveable to a position so that the lower guide ring and the upper guide ring apply a compressive force on the lower sealing element and the upper sealing element, the compressive force causing the lower sealing element and the upper sealing element to be compressed and to extend outward from the annular safety value and into contact with inner surface of casing to form the fluid seal.

What is claimed is:

1. An apparatus comprising:

a sealing assembly comprising a stack of components including an upper sealing element and a lower sealing element, an upper guide ring, a lower guide ring, an upper shoe, and a spacer, the sealing assembly configured to encircle a tubular element positioned within a casing of a wellbore and to be actuatable to extend between the tubular element and an inner surface of the casing to form a fluid seal between the tubular element and the inner surface of the casing, wherein the fluid seal is provided at least in part by the upper sealing element and the lower sealing element, wherein the stack of components is arranged so that the upper shoe is positioned adjacent to the upper guide ring, the upper sealing element is positioned lower from and in direct contact with the upper shoe, the spacer is positioned lower from and in direct contact with a lower surface of the upper sealing element, the lower sealing element is positioned lower from the spacer and having an upper surface in direct contact with the spacer, and the lower guide ring is positioned lower from and in direct contact with a lower surface of the lower sealing element, the upper sealing element formed from a first single piece of elastomeric material, the lower sealing element formed from a second single piece of elastomeric material, the upper guide ring formed from a third single piece of rigid material, and the lower guide ring formed from a fourth single piece of rigid material, wherein an inner surface of the upper shoe extends from the tubular element and along and in direct physical contact with a portion of an outer surface of the upper sealing element, and wherein the upper sealing element and the lower sealing element are asymmetrical relative to each other in that the lower sealing element has a first height dimension that is greater than a second height dimension of the upper sealing element;

and the lower guide ring having a portion extending into a lower guide ring retainer having a first cavity adjacent to a lower surface of the lower guide ring, the first cavity in fluid communication with a fluid passageway configured to provide fluid pressure to the first cavity, wherein the sealing assembly is configured to be actuated when a minimum level of fluid pressure is applied to the first cavity causing the lower guide ring to extend further from the first cavity and apply a compressive force to the lower sealing element.

2. The apparatus of claim 1, wherein the spacer is configured to at least partially separate the upper sealing element from the lower sealing element.

3. The apparatus of claim 2, wherein the spacer is formed from a rigid material including metal.

4. The apparatus of claim 1, wherein the lower sealing element includes a second cavity along an inner surface of the lower sealing element, the second cavity extending in an outward direction toward but not extending fully to an outer surface of the lower sealing element, the outer surface of the lower sealing element opposite the inner surface of the lower sealing element.

5. The apparatus of claim 1, further comprising the upper shoe having a shape that conforms to and is in direct physical contact with an upper surface of the upper sealing element.

6. The apparatus of claim 1, wherein the lower guide ring configured to exert a force in an upward direction on the lower sealing element during actuation of the sealing assembly, the force in the upward direction configured to compress both the upper sealing element and the lower sealing element, causing the upper sealing element and the lower sealing element to be compressed longitudinally and to expand in an outward direction toward the inner surface of the casing of the wellbore.

7. The apparatus of claim 1, wherein the sealing assembly is configured to provide the fluid seal between a first annulus of the wellbore and a second annulus of the wellbore having a pressure differential of up to 10,000 pounds/square inch between the first annulus and the second annulus.

8. The apparatus to claim 1, further comprising a reinforcement ring that is embedded within the lower sealing element.

9. The apparatus of claim 1, wherein the sealing assembly further includes a reinforcement ring positioned proximate to a corner of the lower sealing element adjacent to an outer surface and the lower surface of the lower sealing element, the reinforcement ring comprising a rigid material and configured to prevent one or more portions of the lower sealing element from extruding over an outer surface of a the lower guide ring positioned adjacent to the lower surface of the lower sealing element.

10. An apparatus comprising:

a sealing assembly comprising a stack of components including an upper sealing element and a lower sealing element, an upper guide ring, a lower guide ring, an upper shoe, and a spacer, the sealing assembly configured to encircle an annular safety valve positioned on a tubular element and configured to be lowered into a casing of a wellbore, the sealing assembly configured to be actuatable to extend between an outer surface of the annular safety valve and an inner surface of the casing of the wellbore to form a fluid seal between the outer surface of the annular safety valve and the inner surface of the casing, wherein the fluid seal is provided at least in part by the upper sealing element and the lower sealing element, wherein the stack of components is arranged so that the upper shoe is positioned adjacent to the upper guide ring, the upper sealing element is positioned lower from and in direct contact with the upper shoe, the spacer is positioned lower from and in direct contact with a lower surface of the upper sealing element, the lower sealing element is positioned lower from the spacer and having an upper surface in direct contact with the spacer, and the lower guide ring is positioned lower from and in direct contact with a lower surface of the lower scaling element, the upper sealing element formed from a first single piece elastomeric material, the lower sealing element formed from a second single piece of elastomeric material, the upper guide ring formed from a third single piece of rigid material, and the lower guide ring formed from a fourth single piece of rigid material, wherein an inner surface of the upper shoe extends from the annular safety valve and along and in direct physical contact with a portion of an outer surface of the upper sealing element, and wherein the upper sealing element and the lower sealing element are asymmetrical relative to each other in that the lower sealing element has a first height dimension that is greater than a second height dimension of the upper sealing element, and the lower guide ring having a portion extending into a lower guide ring retainer having a first cavity adjacent to a lower surface of the lower guide ring, the first cavity in fluid communication with a fluid passageway included in the annular safety valve, wherein the sealing assembly is configured to be actuated when a minimum level of fluid pressure is applied to the first cavity causing the lower guide ring to extend further from the first cavity and apply a compressive force to the lower sealing element.

11. The apparatus of claim 10, wherein the sealing assembly, when actuated, is configured to form the fluid seal separating a first annulus positioned uphole from the sealing assembly from a second annulus positioned downhole from the sealing assembly, and wherein the annular safety valve includes one or more fluid passageways that extend from the first annulus to the second annulus, the one or more fluid passageways configured to be controllably opened to allow fluid pressure provided to the first annulus to be communicated to the second annulus as part of a gas lift operation being performed on the wellbore.

12. The apparatus of claim 10, wherein the spacer is configured to at least partially separate the upper sealing element from the lower sealing element.

13. The apparatus of claim 10, wherein the lower sealing element includes a second cavity forming a groove along an inner surface of the lower sealing element, the second cavity extending in an outward direction toward but not extending fully to an outer surface of the lower sealing element, the outer surface opposite the inner surface of the lower sealing element, and wherein the second cavity includes a retention ring having a ring shape that encircles the inner surface of the lower sealing element.

14. A method comprising:

conveying a tubing assembly into a casing of a wellbore, the tubing assembly comprising a tubular string, an annular safety valve encircling the tubular string, and an asymmetrical sealing assembly encircling the annular safety valve, the asymmetrical sealing assembly configured to be actuatable to extend between an outer surface of the annular safety valve and an inner surface of the casing to form a fluid seal between the tubing assembly and the inner surface of the casing, wherein the asymmetrical sealing element comprising a stack of components including an upper sealing element, a lower sealing element, an upper guide ring, a lower guide ring, an upper shoe, and a spacer, the stack of components arranged so that the upper shoe is positioned adjacent to the upper guide ring, the upper sealing element is positioned lower from and in direct contact with the upper shoe, the spacer is positioned lower from and in direct contact with a lower surface of the upper sealing element, the lower sealing element is positioned lower from the spacer and having an upper surface in direct contact with the spacer, and the lower guide ring is positioned lower from and in direct contact with a lower surface of the lower sealing element, the upper sealing element formed from a first single piece of elastomeric material, the lower sealing element formed from a second single piece of elastomeric material, the upper guide ring formed from a third single piece of rigid material, and the lower guide ring formed from a fourth single piece of rigid material, wherein an inner surface of the upper shoe extends from the annular safety valve and along and in direct physical contact with a portion of an outer surface of the upper sealing element, wherein the upper sealing element and the lower sealing element are asymmetrical relative to each other in that the lower sealing element has a first height dimension that is greater than a second height dimension of the upper sealing element and the lower guide ring having a portion extending into a lower guide ring retainer having a cavity adjacent to a lower surface of the lower guide ring, the cavity in fluid communication with a fluid passageway included in the annular safety valve, wherein the sealing assembly is configured to be actuated when a minimum level of fluid pressure is applied to the cavity causing the lower guide ring to extend further from the cavity and apply a compressive force to the lower sealing element; and deploying the asymmetric sealing assembly in order to form the fluid seal.

15. The method of claim 14, initiating operations on the wellbore comprising:

setting the annular safety valve to an open position;

applying fluid pressure to a first annulus formed within the wellbore and uphole of the position of the asymmetrical sealing assembly, and separated from a second annulus formed within the wellbore and downhole of the position of the asymmetrical sealing assembly;

controllably allowing the fluid pressure applied to the first annulus to be provided to the second annulus through one or more fluid passageways provided through the annular safety valve; and monitoring a pressure level in the second annulus.

16. The method of claim 15, further comprising:

determining that the pressure in the second annulus is above a safety threshold level, and setting the annulare safety valve to a closed position while maintaining the fluid seal between the first annulus and the second annulus using the asymmetrical sealing assembly remaining in an actuated configuration.

17. The method of claim 14, the compressive force causing the lower sealing element and the upper sealing element to be compressed and to extend outward from the annular safety valve and into contact with inner surface of casing to form the fluid seal.

* * * * *